US011134720B2

(12) United States Patent
Nakano et al.

(10) Patent No.: US 11,134,720 B2
(45) Date of Patent: Oct. 5, 2021

(54) POWER SUPPLY UNIT FOR AEROSOL INHALER AND AEROSOL INHALER

(71) Applicant: Japan Tobacco Inc., Tokyo (JP)

(72) Inventors: Takuma Nakano, Tokyo (JP); Keiji Marubashi, Tokyo (JP); Hajime Fujita, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 17/191,703

(22) Filed: Mar. 4, 2021

(65) Prior Publication Data

US 2021/0274851 A1 Sep. 9, 2021

(30) Foreign Application Priority Data

Mar. 5, 2020 (JP) ..... JP2020-038194

(51) Int. Cl.
*A24F 13/00* (2006.01)
*A24F 40/57* (2020.01)
(Continued)

(52) U.S. Cl.
CPC ..... *A24F 40/57* (2020.01); *A24F 40/53* (2020.01); *A24F 40/51* (2020.01)

(58) Field of Classification Search
CPC ..... A24F 47/00
(Continued)

(56) References Cited

U.S. PATENT DOCUMENTS

2013/0027213 A1 1/2013 Miyata et al.
2016/0143361 A1* 5/2016 Juster ..... A24F 40/53 392/404
(Continued)

FOREIGN PATENT DOCUMENTS

JP 2013-31121 A 2/2013
JP 2016-533712 A 11/2016
(Continued)

OTHER PUBLICATIONS

Notice of Reasons for Refusal dated Jun. 2, 2020, received for JP Application 2020-038194, 9 pages including English Translation.
(Continued)

*Primary Examiner* — Phuong K Dinh
(74) *Attorney, Agent, or Firm* — Xsensus LLP

(57) ABSTRACT

A power supply unit for an aerosol inhaler includes a power supply dischargeable to a load for heating an aerosol generation source, a first sensor configured to output a signal indicating an aerosol generation request, and a processing device configured to acquire the signal. The processing device causes the power supply unit to operate in a first mode in which a maximum power consumption amount is a first amount and a second mode in which a maximum power consumption amount is smaller than the first amount, causes the power supply unit to operate in the second mode when a period during which the signal is not acquired exceeds a predetermined time in the first mode, and causes the power supply unit to operate such that a maximum power consumption amount is less than the first amount at a timing before the period exceeds the predetermined time in the first mode.

8 Claims, 13 Drawing Sheets

(51) Int. Cl.
*A24F 40/53* (2020.01)
*A24F 40/51* (2020.01)

(58) Field of Classification Search
USPC ..... 131/328–329
See application file for complete search history.

(56) References Cited

U.S. PATENT DOCUMENTS

| | | | | |
|---|---|---|---|---|
| 2016/0242466 | A1 | 8/2016 | Lord et al. | |
| 2016/0309788 | A1* | 10/2016 | Hawes | A24F 40/53 |
| 2018/0184711 | A1 | 7/2018 | Dickens et al. | |
| 2019/0133192 | A1 | 5/2019 | Lord et al. | |
| 2019/0364957 | A1 | 12/2019 | Fu et al. | |

FOREIGN PATENT DOCUMENTS

| | | | |
|---|---|---|---|
| JP | 2019-150023 | A | 9/2019 |
| WO | 2013/025921 | A1 | 2/2013 |
| WO | 2017141359 | A1 | 8/2017 |
| WO | 2019/005526 | A1 | 1/2019 |
| WO | 2019/141577 | A1 | 7/2019 |

OTHER PUBLICATIONS

Decision to Grant dated Oct. 20, 2020, received for JP Application 2020-038194, 5 pages including English Translation.
European Search Report dated Jul. 30, 2021, in corresponding European Patent Application No. 21160961.5.

* cited by examiner

POWER SUPPLY UNIT FOR AEROSOL INHALER AND AEROSOL INHALER

CROSS-REFERENCE TO RELATED APPLICATION

This application claims priority to Japanese Patent Application No. 2020-038194 filed on Mar. 5, 2020, the content of which is incorporated herein by reference.

TECHNICAL FIELD

The present invention relates to a power supply unit for an aerosol inhaler and an aerosol inhaler.

BACKGROUND ART

JP 2019-150023 A discloses a device configured to generate an inhalable aerosol. The device includes at least a heater configured for an ON mode and a standby mode, a sensor configured to detect a movement of the device, and a controller configured to convert from the standby mode to the ON mode based on detection of the movement of the device by the sensor.

When an aerosol inhaler is driven by a battery, it is important to reduce power consumption in order to increase a commercial value. In JP 2019-150023 A, sufficient power reduction cannot be implemented.

It is an object of the present invention to increase the commercial value of the aerosol inhaler.

SUMMARY OF INVENTION

According to an aspect of the present invention, there is provided a power supply unit for an aerosol inhaler includes a power supply dischargeable to a load configured to heat an aerosol generation source, a first sensor configured to output a signal indicating an aerosol generation request, and a processing device configured to acquire the signal from the first sensor. The processing device causes the power supply unit to operate in a first mode in which a maximum power consumption amount is a first power consumption amount and a second mode in which a maximum power consumption amount is smaller than the first power consumption amount, and causes the power supply unit to operate in the second mode when a period during which the signal is not acquired exceeds a predetermined time in the first mode. The processing device causes the power supply unit to operate such that a maximum power consumption amount is less than the first power consumption amount at a timing before the period exceeds the predetermined time in the first mode.

DESCRIPTION OF EMBODIMENTS

Hereinafter, an aerosol inhaler 1, which is an embodiment of an aerosol inhaler of the present invention, will be described with reference to FIGS. 1 to 5.

(Aerosol Inhaler)

Figure 1:
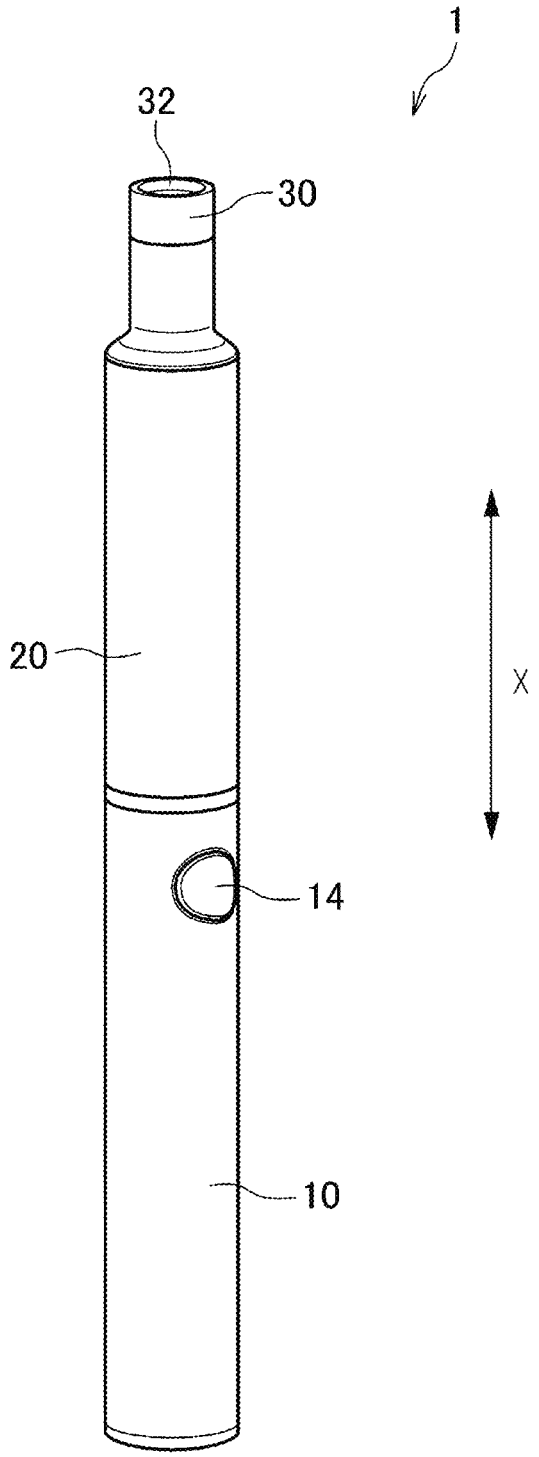
FIG. 1 is a perspective view schematically showing a schematic configuration of an aerosol inhaler.
Figure 2:
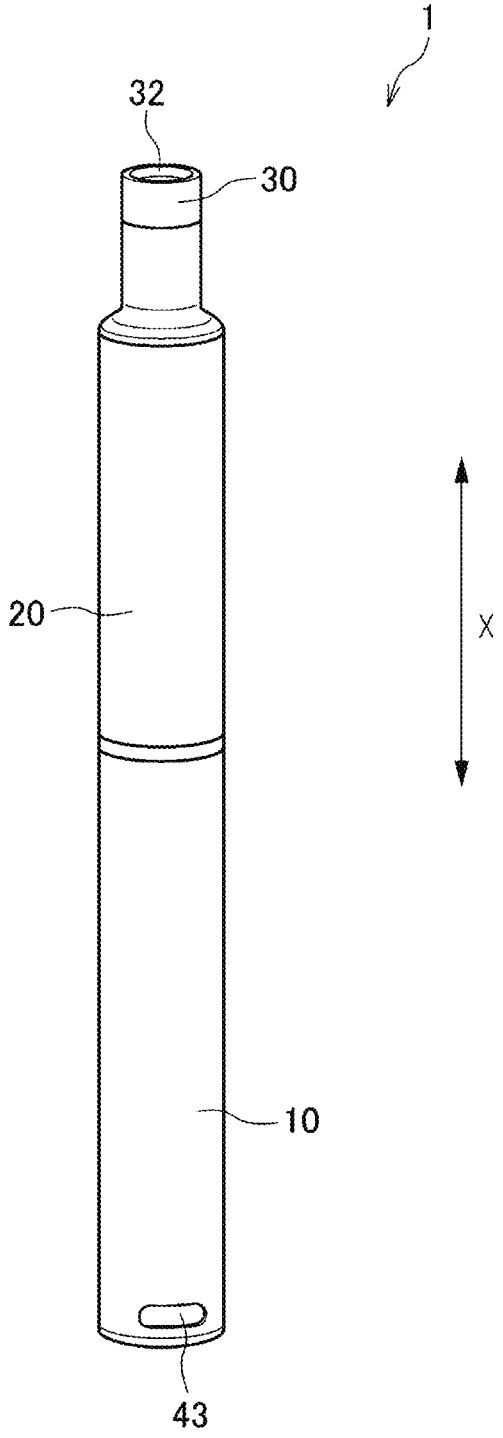
FIG. 2 is another perspective view of the aerosol inhaler of FIG. 1.
Figure 3:
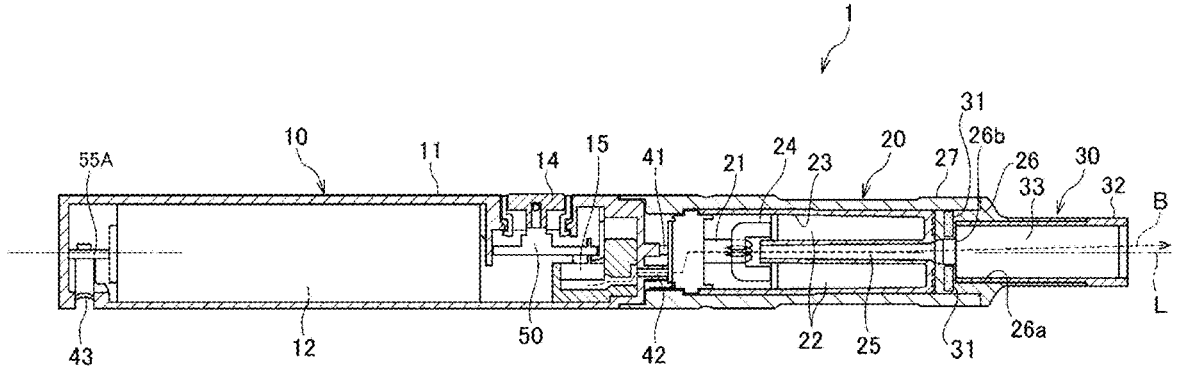
FIG. 3 is a cross-sectional view of the aerosol inhaler of FIG. 1.

The aerosol inhaler 1 is a device for generating an aerosol to which a flavor component is added without burning and making it possible to suck the aerosol, and has a rod shape that extends along a predetermined direction (hereinafter, referred to as longitudinal direction X) as shown in FIGS. 1 and 2. In the aerosol inhaler 1, a power supply unit 10, a first cartridge 20, and a second cartridge 30 are provided in this order along the longitudinal direction X. The first cartridge 20 is attachable to and detachable from (in other words, replaceable with respect to) the power supply unit 10. The second cartridge 30 is attachable to and detachable from (in other words, replaceable with respect to) the first cartridge 20. As shown in FIG. 3, the first cartridge 20 is provided with a first load 21 and a second load 31. As shown in FIG. 1, an overall shape of the aerosol inhaler 1 is not limited to a shape in which the power supply unit 10, the first cartridge 20, and the second cartridge 30 are lined up in a row. As long as the first cartridge 20 and the second cartridge 30 are replaceable with respect to the power supply unit 10, any shape such as a substantial box shape can be adopted. The second cartridge 30 may be attachable to and detachable from (in other words, replaceable with respect to) the power supply unit 10.

(Power Supply Unit)

Figure 4:
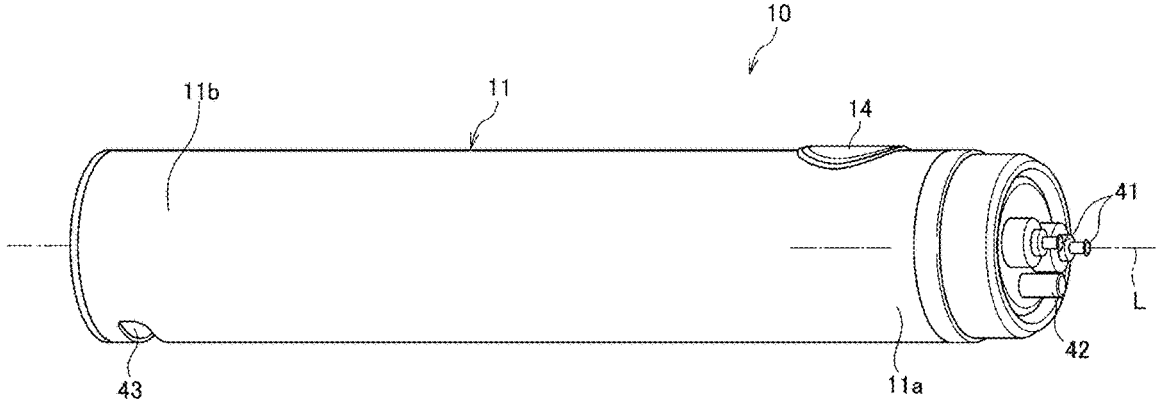
FIG. 4 is a perspective view of a power supply unit of the aerosol inhaler of FIG. 1.
Figure 5:
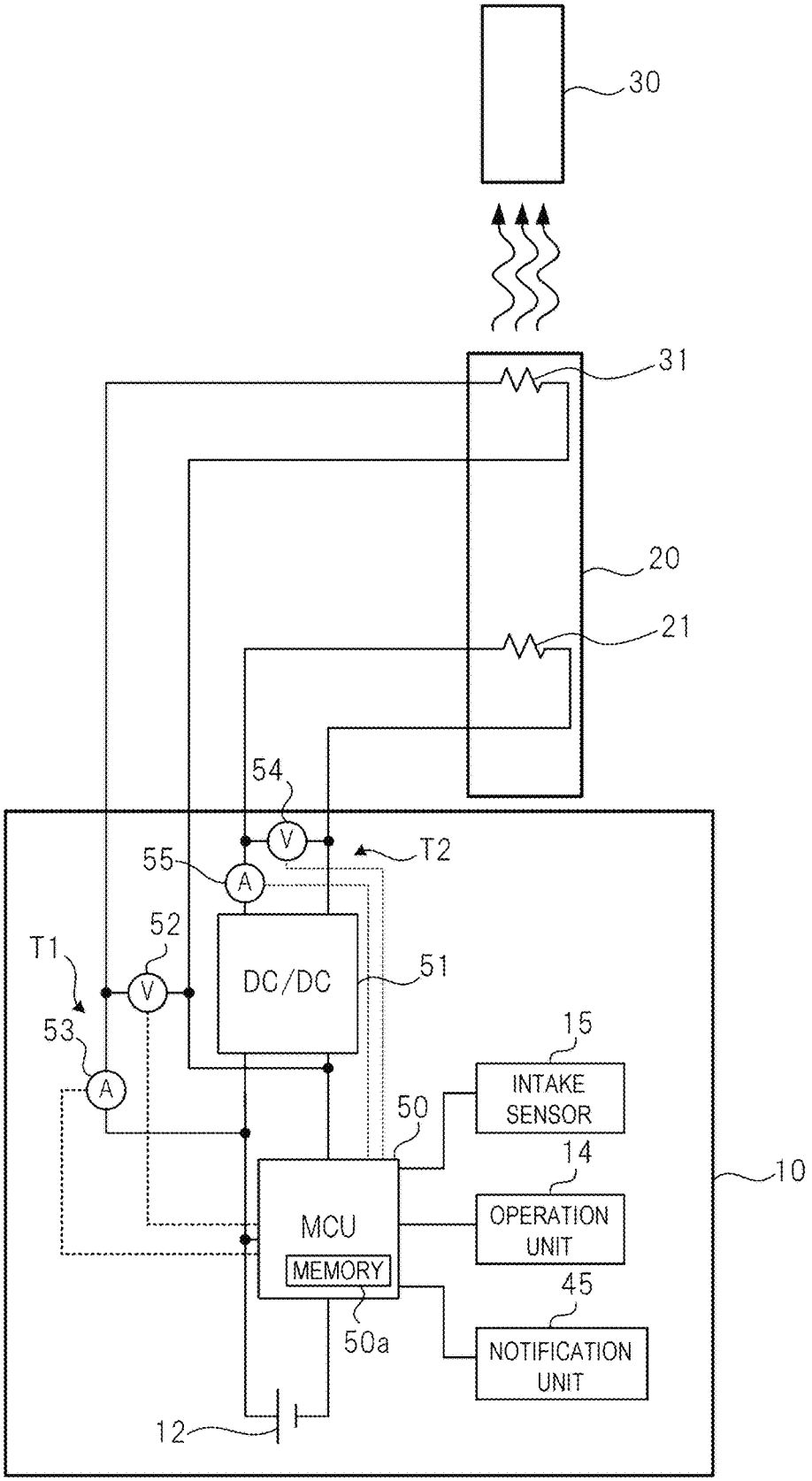
FIG. 5 is a schematic diagram showing a hardware configuration of the aerosol inhaler of FIG. 1.

As shown in FIGS. 3, 4, and 5, the power supply unit 10 houses a power supply 12, a charging IC 55A, a micro controller unit (MCU) 50, a DC/DC converter 51, an intake sensor 15, a temperature detection element T1 including a voltage sensor 52 and a current sensor 53, and a temperature detection element T2 including a voltage sensor 54 and a current sensor 55 inside a cylindrical power supply unit case 11.

The power supply 12 is a rechargeable secondary battery, an electric double-layer capacitor, or the like, and is preferably a lithium-ion secondary battery. An electrolyte of the power supply 12 may be one of or a combination of a gel-like electrolyte, an electrolytic solution, a solid electrolyte, and an ionic liquid.

As shown in FIG. 5, the MCU 50 is connected to various sensor devices such as the intake sensor 15, the voltage sensor 52, the current sensor 53, the voltage sensor 54, and the current sensor 55, the DC/DC converter 51, an operation unit 14, and a notification unit 45, and performs various kinds of control of the aerosol inhaler 1.

Specifically, the MCU 50 is mainly configured with a processor, and further includes a memory 50*a* configured with a storage medium such as a random access memory (RAM) required for an operation of the processor and a read only memory (ROM) that stores various pieces of information. Specifically, the processor in the present description is an electric circuit in which circuit elements such as semiconductor elements are combined.

As shown in FIG. 4, discharging terminals 41 are provided on a top portion 11*a* positioned on one end side of the power supply unit case 11 in the longitudinal direction X (a first cartridge 20 side). The discharging terminal 41 is provided so as to protrude from an upper surface of the top portion 11*a* toward the first cartridge 20, and can be electrically connected to the first load 21 and the second load 31 of the first cartridge 20.

On the upper surface of the top portion 11*a*, an air supply unit 42 that supplies air to the first load 21 of the first cartridge 20 is provided in the vicinity of the discharging terminals 41.

A charging terminal 43 that can be electrically connected to an external power supply (not shown) is provided in a bottom portion 11*b* positioned on the other end side of the power supply unit case 11 in the longitudinal direction X (a side opposite to the first cartridge 20).

The charging terminal 43 is provided in a side surface of the bottom portion 11*b*, and can be connected to, for example, a Universal Serial Bus (USB) terminal, a micro USB terminal, a Lightning (registered trademark) terminal, or the like.

The charging terminal 43 may be a power reception unit that can receive power transmitted from an external power supply in a wireless manner. In such a case, the charging terminal 43 (the power reception unit) may be configured with a power reception coil. A method for wireless power transfer may be an electromagnetic induction type or a magnetic resonance type. Further, the charging terminal 43 may be a power reception unit that can receive power transmitted from an external power supply without contact. As another example, the charging terminal 43 may be connected to the USB terminal, the micro USB terminal, or the Lightning terminal, and may include the power reception unit described above.

The power supply unit case 11 is provided with the operation unit 14 that can be operated by a user in the side surface of the top portion 11*a* so as to face a side opposite to the charging terminal 43. More specifically, the operation unit 14 and the charging terminal 43 have a point-symmetrical relationship with respect to an intersection between a straight line connecting the operation unit 14 and the charging terminal 43 and a center line of the power supply unit 10 in the longitudinal direction X. The operation unit 14 is configured with a button-type switch, a touch panel, or the like.

As shown in FIG. 3, the intake sensor 15 that detects a puff (suction) operation is provided in the vicinity of the operation unit 14. The power supply unit case 11 is provided with an air intake port (not shown) that takes outside air into the power supply unit case 11. The air intake port may be provided around the operation unit 14 or may be provided around the charging terminal 43.

The intake sensor 15 is configured to output a value of a pressure (an internal pressure) change in the power supply unit 10 caused by suction of the user through a suction port 32 described later. The intake sensor 15 is, for example, a pressure sensor that outputs an output value (for example, a voltage value or a current value) corresponding to an internal pressure that changes according to a flow rate of air sucked from the air intake port toward the suction port 32 (that is, a puff operation of the user). The intake sensor 15 may output an analog value or may output a digital value converted from the analog value.

The intake sensor 15 may incorporate a temperature sensor that detects a temperature of an environment (an outside air temperature) in which the power supply unit 10 is placed in order to compensate for a detected pressure. The intake sensor 15 may be configured with a condenser microphone or the like instead of the pressure sensor.

When a puff operation is performed and an output value of the intake sensor 15 is larger than a threshold, the MCU 50 determines that an aerosol generation request has been made, and then, when the output value of the intake sensor 15 is smaller than the threshold, the MCU 50 determines that the aerosol generation request has been ended. In the aerosol inhaler 1, when a period during which the aerosol generation request is made reaches a first default value $t_{upper}$ (for example, 2.4 seconds) for a purpose of preventing overheating of the first load 21 or the like, it is determined that the aerosol generation request has been ended regardless of an output value of the intake sensor 15. Accordingly, the output value of the intake sensor 15 is used as a signal indicating the aerosol generation request. Therefore, the intake sensor 15 constitutes a sensor that outputs an aerosol generation request.

Instead of the intake sensor 15, the aerosol generation request may be detected based on an operation of the operation unit 14. For example, when the user performs a predetermined operation on the operation unit 14 to start sucking aerosol, the operation unit 14 may be configured to output a signal indicating the aerosol generation request to the MCU 50. In this case, the operation unit 14 constitutes a sensor that outputs an aerosol generation request.

The charging IC 55A is disposed close to the charging terminal 43, and controls charging of power input from the charging terminal 43 to the power supply 12. The charging IC 55A may be disposed in the vicinity of the MCU 50.

(First Cartridge)

As shown in FIG. 3, the first cartridge 20 includes inside a cylindrical cartridge case 27, a reservoir 23 that stores an aerosol source 22, the first load 21 for atomizing the aerosol source 22, a wick 24 that draws the aerosol source from the reservoir 23 to the first load 21, an aerosol flow path 25 in which an aerosol generated by atomizing the aerosol source 22 flows toward the second cartridge 30, an end cap 26 that houses a part of the second cartridge 30, and the second load 31 provided in the end cap 26 and configured to heat the second cartridge 30.

The reservoir 23 is partitioned and formed so as to surround a periphery of the aerosol flow path 25 and stores the aerosol source 22. The reservoir 23 may house a porous body such as a resin web or cotton, and the aerosol source 22 may be impregnated in the porous body. The reservoir 23 may not house the porous body in the resin web or cotton and may only store the aerosol source 22. The aerosol source 22 contains a liquid such as glycerin, propylene glycol, or water.

The wick 24 is a liquid holding member that draws the aerosol source 22 from the reservoir 23 to the first load 21 by using a capillary phenomenon. The wick 24 is formed of, for example, glass fiber or porous ceramic.

The first load 21 atomizes the aerosol source 22 by heating the aerosol source 22 without burning by power supplied from the power supply 12 via the discharging terminals 41. The first load 21 is configured with an electric heating wire (a coil) wound at a predetermined pitch.

The first load 21 may be an element that can generate an aerosol by atomizing the aerosol source 22 by heating the aerosol source 22. The first load 21 is, for example, a heat generation element. Examples of the heat generation element include a heat generation resistor, a ceramic heater, and an induction heating type heater.

As the first load 21, a load in which a temperature and an electric resistance value have a correlation is used. As the first load 21, for example, a load having a positive temperature coefficient (PTC) characteristic in which the electric resistance value increases as the temperature increases is used.

The aerosol flow path 25 is provided on a downstream side of the first load 21 and on a center line L of the power supply unit 10. The end cap 26 includes a cartridge housing portion 26*a* that houses a part of the second cartridge 30, and a communication path 26*b* that causes the aerosol flow path 25 and the cartridge housing portion 26*a* to communicate with each other.

The second load 31 is embedded in the cartridge housing portion 26*a*. The second load 31 heats the second cartridge 30 (more specifically, a flavor source 33 included herein) housed in the cartridge housing portion 26*a* by the power supplied from the power supply 12 via the discharging terminals 41. The second load 31 is configured with, for example, an electric heating wire (a coil) wound at a predetermined pitch.

The second load 31 may be any element that can heat the second cartridge 30. The second load 31 is, for example, a heat generation element. Examples of the heat generation element include a heat generation resistor, a ceramic heater, and an induction heating type heater.

As the second load 31, a load in which a temperature and an electric resistance value have a correlation is used. As the second load 31, for example, a load having the PTC characteristic is used.

(Second Cartridge)

The second cartridge 30 stores the flavor source 33. When the second cartridge 30 is heated by the second load 31, the flavor source 33 is heated. The second cartridge 30 is detachably housed in the cartridge housing portion 26*a* provided in the end cap 26 of the first cartridge 20. An end portion of the second cartridge 30 on a side opposite to the first cartridge 20 side is the suction port 32 for the user. The suction port 32 is not limited to being integrally formed with the second cartridge 30 and may be attachable to and detachable from the second cartridge 30. Accordingly, the suction port 32 is configured separately from the power supply unit 10 and the first cartridge 20, so that the suction port 32 can be kept hygienic.

The second cartridge 30 adds a flavor component to an aerosol by passing, through the flavor source 33, the aerosol generated by atomizing the aerosol source 22 by the first load 21. As a raw material piece that constitutes the flavor source 33, cut tobacco or a molded body obtained by molding a tobacco raw material into a granular shape can be used. The flavor source 33 may be configured with a plant other than the tobacco (for example, mint, Chinese medicine, or herbs). A fragrance such as menthol may be added to the flavor source 33.

In the aerosol inhaler 1, the aerosol source 22 and the flavor source 33 can generate an aerosol to which a flavor component is added. That is, the aerosol source 22 and the flavor source 33 constitute an aerosol generation source that generates the aerosol.

The aerosol generation source of the aerosol inhaler 1 is a portion that the user replaces and uses. This portion is provided to the user, for example, as a set of one first cartridge 20 and one or a plurality of (for example, five) second cartridges 30. Therefore, in the aerosol inhaler 1, a replacement frequency of the power supply unit 10 is lowest, a replacement frequency of the first cartridge 20 is second lowest, and a replacement frequency of the second cartridge 30 is highest. Therefore, it is important to reduce a manufacturing cost of the first cartridge 20 and the second cartridge 30. The first cartridge 20 and the second cartridge 30 may be integrated into one cartridge.

In the aerosol inhaler 1 configured in this way, as indicated by an arrow B in FIG. 3, air that flows in from the intake port (not shown) provided in the power supply unit case 11 passes from the air supply unit 42 to a vicinity of the first load 21 of the first cartridge 20. The first load 21 atomizes the aerosol source 22 drawn from the reservoir 23 by the wick 24. An aerosol generated by atomization flows through the aerosol flow path 25 together with the air that flows in from the intake port, and is supplied to the second cartridge 30 via the communication path 26*b*. The aerosol supplied to the second cartridge 30 passes through the flavor source 33 to add a flavor component and is supplied to the suction port 32.

The aerosol inhaler 1 is provided with the notification unit 45 that notifies various pieces of information (see FIG. 5). The notification unit 45 may be configured with a light-emitting element, may be configured with a vibration element, or may be configured with a sound output element. The notification unit 45 may be a combination of two or more elements among the light-emitting element, the vibration element, and the sound output element. The notification unit 45 may be provided in any of the power supply unit 10, the first cartridge 20, and the second cartridge 30, but is preferably provided in the power supply unit 10. For example, a periphery of the operation unit 14 is translucent, and is configured to emit light by a light-emitting element such as an LED.

(Details of Power Supply Unit)

As shown in FIG. 5, in a state where the first cartridge 20 is mounted on the power supply unit 10, the DC/DC converter 51 is connected between the first load 21 and the power supply 12. The MCU 50 is connected between the DC/DC converter 51 and the power supply 12. In a state where the first cartridge 20 is mounted on the power supply unit 10, the second load 31 is connected to a connection node between the MCU 50 and the DC/DC converter 51. Accordingly, in the power supply unit 10, in a state where the first cartridge 20 is mounted, the second load 31 and a series circuit of the DC/DC converter 51 and the first load 21 are connected in parallel to the power supply 12.

The DC/DC converter 51 is a boosting circuit that can boost an input voltage, and is configured to be able to supply an input voltage or a voltage obtained by boosting the input voltage to the first load 21. Since power supplied to the first load 21 can be adjusted by the DC/DC converter 51, an amount of the aerosol source 22 to be atomized by the first load 21 can be controlled. As the DC/DC converter 51, for example, a switching regulator that converts an input voltage into a desired output voltage can be used by controlling on/off time of a switching element while monitoring the output voltage. When the switching regulator is used as the DC/DC converter 51, the input voltage can be output as it is without boosting by controlling the switching element.

The processor of the MCU 50 is configured to be able to acquire a temperature of the flavor source 33 in order to control discharging to the second load 31, which will be described later. The processor of the MCU 50 is preferably configured to be able to acquire a temperature of the first load 21. The temperature of the first load 21 can be used to prevent overheating of the first load 21 and the aerosol source 22 and to highly control the amount of the aerosol source 22 to be atomized by the first load 21.

The voltage sensor 52 measures and outputs a value of a voltage applied to the second load 31. The current sensor 53 measures and outputs a value of a current that flows through the second load 31. An output of the voltage sensor 52 and an output of the current sensor 53 are input to the MCU 50. The processor of the MCU 50 acquires a resistance value of the second load 31 based on the output of the voltage sensor 52 and the output of the current sensor 53, and acquires a temperature of the second load 31 according to the resistance value. The temperature of the second load 31 does not exactly coincide with a temperature of the flavor source 33 heated by the second load 31, but can be regarded as substantially the same as the temperature of the flavor source 33. Therefore, the temperature detection element T1 constitutes a temperature detection element for detecting the temperature of the flavor source 33.

If a constant current flows to the second load 31 when the resistance value of the second load 31 is acquired, the current sensor 53 is unnecessary in the temperature detection element T1. Similarly, if a constant voltage is applied to the second load 31 when the resistance value of the second load 31 is acquired, the voltage sensor 52 is unnecessary in the temperature detection element T1.

Figure 6:
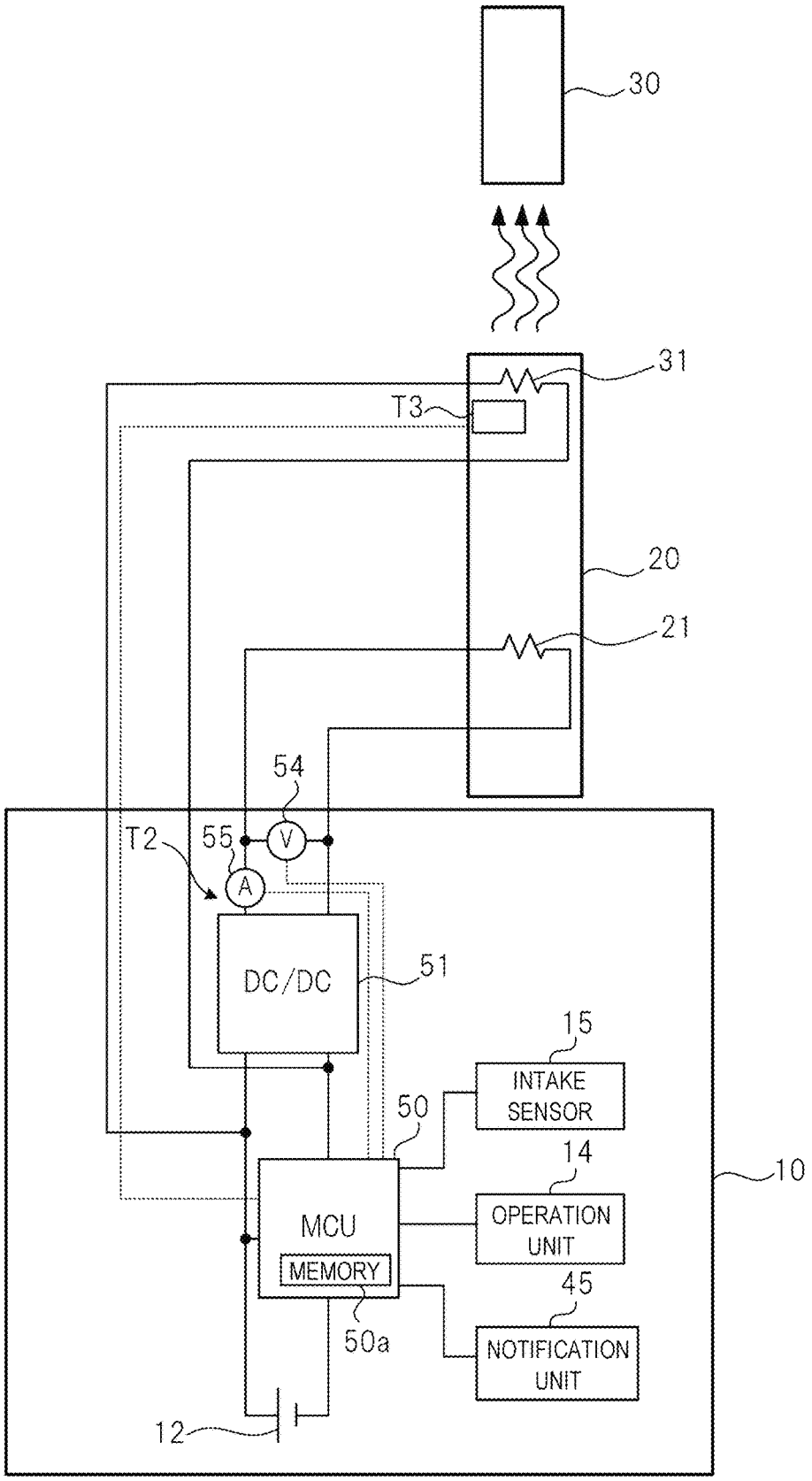
FIG. 6 is a schematic diagram showing a modification of the hardware configuration of the aerosol inhaler of FIG. 1.

As shown in FIG. 6, instead of the temperature detection element T1, the first cartridge 20 may be provided with a temperature detection element T3 for detecting a temperature of the second cartridge 30. The temperature detection element T3 is configured with, for example, a thermistor disposed in the vicinity of the second cartridge 30. In the configuration of FIG. 6, the processor of the MCU 50 acquires the temperature of the second cartridge 30 (in other words, the flavor source 33) based on an output of the temperature detection element T3.

As shown in FIG. 6, since the temperature of the second cartridge 30 (the flavor source 33) is acquired by using the temperature detection element T3, compared with acquiring the temperature of the flavor source 33 by using the temperature detection element T1 in FIG. 5, the temperature of the flavor source 33 can be more accurately acquired. The temperature detection element T3 may be mounted on the second cartridge 30. According to the configuration shown in FIG. 6 in which the temperature detection element T3 is mounted on the first cartridge 20, a manufacturing cost of the second cartridge 30 having highest replacement frequency in the aerosol inhaler 1 can be reduced.

As shown in FIG. 5, when the temperature of the second cartridge 30 (the flavor source 33) is acquired by using the temperature detection element T1, the temperature detection element T1 can be provided in the power supply unit 10 having lowest replacement frequency in the aerosol inhaler 1. Therefore, manufacturing costs of the first cartridge 20 and the second cartridge 30 can be reduced.

The voltage sensor 54 measures and outputs a value of a voltage applied to the first load 21. The current sensor 55 measures and outputs a value of a current that flows through the first load 21. An output of the voltage sensor 54 and an output of the current sensor 55 are input to the MCU 50. The processor of the MCU 50 acquires a resistance value of the first load 21 based on the output of the voltage sensor 54 and the output of the current sensor 55, and acquires a temperature of the first load 21 according to the resistance value. If a constant current flows to the first load 21 when the resistance value of the first load 21 is acquired, the current sensor 55 is unnecessary in the temperature detection element T2. Similarly, if a constant voltage is applied to the first load 21 when the resistance value of the first load 21 is acquired, the voltage sensor 54 is unnecessary in the temperature detection element T2.

Figure 7:
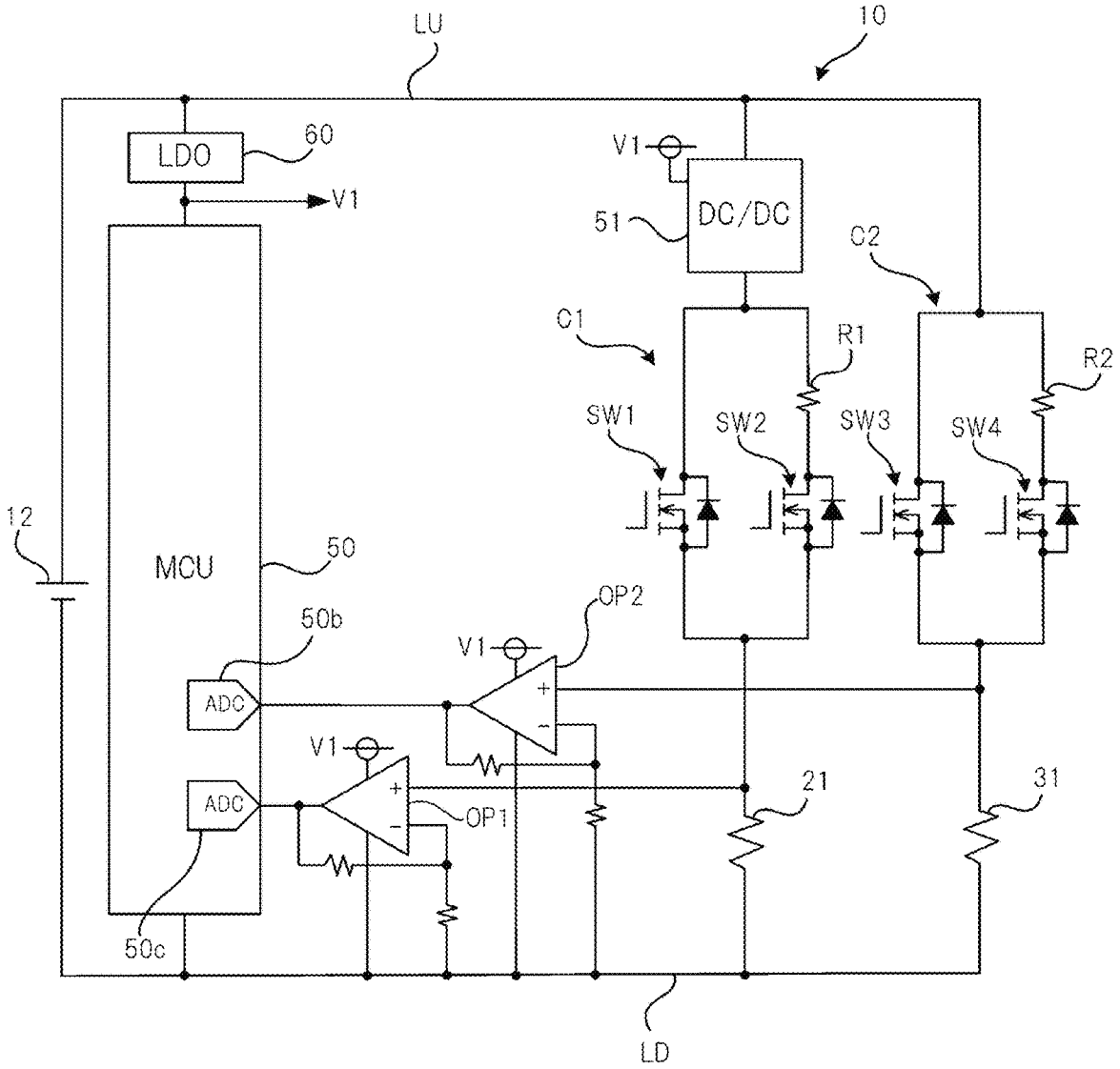
FIG. 7 is a diagram showing a specific example of a power supply unit shown in FIG. 5.

FIG. 7 is a diagram showing a specific example of the power supply unit 10 shown in FIG. 5. FIG. 7 shows a specific example of a configuration in which the temperature detection element T1 does not include the current sensor 53 and the temperature detection element T2 does not include the current sensor 55.

As shown in FIG. 7, the power supply unit 10 includes the power supply 12, the MCU 50, a low drop out (LDO) regulator 60, a switch SW1, a parallel circuit C1 including a series circuit of a resistance element R1 and a switch SW2 connected in parallel to the switch SW1, a switch SW3, a parallel circuit C2 including a series circuit of a resistance element R2 and a switch SW4 connected in parallel to the switch SW3, an operational amplifier OP1 and analog-to-digital converter (hereinafter, referred to as ADC) 50*c* that constitute the voltage sensor 54, and an operational amplifier OP2 and an ADC 50*b* that constitute the voltage sensor 52.

The resistance element described in the present description may be an element having a fixed electric resistance value, for example, a resistor, a diode, or a transistor. In the example of FIG. 7, the resistance element R1 and the resistance element R2 are resistors.

The switch described in the present description is a switching element such as a transistor that switches between interruption and conduction of a wiring path. In the example of FIG. 7, the switches SW1 to SW4 are transistors.

The LDO regulator 60 is connected to a main positive bus LU connected to a positive electrode of the power supply 12. The MCU 50 is connected to the LDO regulator 60 and a main negative bus LD connected to a negative electrode of the power supply 12. The MCU 50 is also connected to the switches SW1 to SW4, and controls opening and closing of these switches. The LDO regulator 60 reduces a voltage from the power supply 12 and outputs the reduced voltage. An output voltage V1 of the LDO regulator 60 is also used as respective operation voltages of the MCU 50, the DC/DC converter 51, the operational amplifier OP1, and the operational amplifier OP2.

The DC/DC converter 51 is connected to the main positive bus LU. The first load 21 is connected to the main negative bus LD. The parallel circuit C1 is connected to the DC/DC converter 51 and the first load 21.

The parallel circuit C2 is connected to the main positive bus LU. The second load 31 is connected to the parallel circuit C2 and the main negative bus LD.

A non-inverting input terminal of the operational amplifier OP1 is connected to a connection node between the parallel circuit C1 and the first load 21. An inverting input terminal of the operational amplifier OP1 is connected to an output terminal of the operational amplifier OP1 and the main negative bus LD via the resistance element.

A non-inverting input terminal of the operational amplifier OP2 is connected to a connection node between the parallel circuit C2 and the second load 31. An inverting input terminal of the operational amplifier OP2 is connected to an output terminal of the operational amplifier OP2 and the main negative bus LD via the resistance element.

The ADC 50*c* is connected to the output terminal of the operational amplifier OP1. The ADC 50*b* is connected to the output terminal of the operational amplifier OP2. The ADC 50*c* and the ADC 50*b* may be provided at an outside of the MCU 50.

Figure 8:
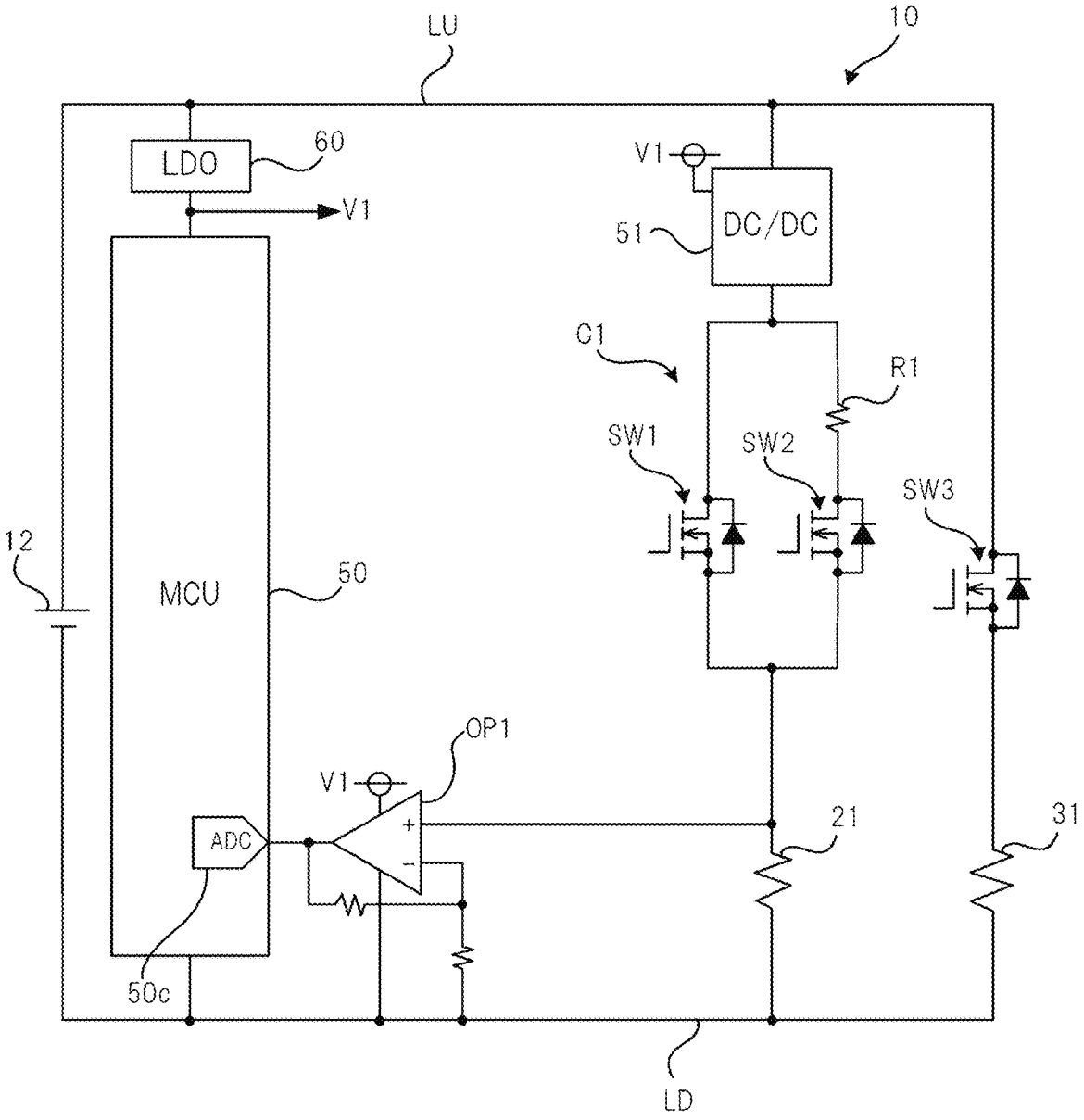
FIG. 8 is a diagram showing a specific example of a power supply unit shown in FIG. 6.

FIG. 8 is a diagram showing a specific example of the power supply unit 10 shown in FIG. 6. FIG. 8 shows a specific example of a configuration in which the temperature detection element T2 does not include the voltage sensor 54. A circuit shown in FIG. 8 has the same configuration as that of FIG. 7 except that the operational amplifier OP2, the ADC 50*b*, the resistance element R2, and the switch SW4 are eliminated.

(MCU)

Next, functions of the MCU 50 will be described. The MCU 50 includes a temperature detection unit, a power control unit, and a notification control unit as a functional block implemented by executing a program stored in a ROM by the processor.

The temperature detection unit acquires a temperature of the flavor source 33 based on an output of the temperature detection element T1 (or the temperature detection element T3). Further, the temperature detection unit acquires a temperature of the first load 21 based on an output of the temperature detection element T2.

In a case of the circuit example shown in FIG. 7, the temperature detection unit controls the switch SW1, the switch SW3, and the switch SW4 to be in an interruption state, acquires an output value of the ADC 50*c* (a value of a voltage applied to the first load 21) in a state where the switch SW2 is controlled to be in a conductive state, and acquires a temperature of the first load 21 based on the output value.

The non-inverting input terminal of the operational amplifier OP1 may be connected to a terminal of the resistance element R1 on a DC/DC converter 51 side, and the inverting input terminal of the operational amplifier OP1 may be connected to a terminal of the resistance element R1 on a switch SW2 side. In this case, the temperature detection unit can control the switch SW1, the switch SW3, and the switch SW4 to be in an interruption state, acquire an output value of the ADC 50*c* (a value of a voltage applied to the resistance element R1) in a state where the switch SW2 is controlled to be in a conductive state, and acquire a temperature of the first load 21 based on the output value.

In the case of the circuit example shown in FIG. 7, the temperature detection unit controls the switch SW1, the switch SW2, and the switch SW3 to be in an interruption state, acquires an output value of the ADC 50*b* (a value of a voltage applied to the second load 31) in a state where the switch SW4 is controlled to be in a conductive state, and acquires a temperature of the second load 31 as a temperature of the flavor source 33 based on the output value.

The non-inverting input terminal of the operational amplifier OP2 may be connected to a terminal of the resistance element R2 on a main positive bus LU side, and the inverting input terminal of the operational amplifier OP2 may be connected to a terminal of the resistance element R2 on a switch SW4 side. In this case, the temperature detection unit can control the switch SW1, the switch SW2, and the switch SW3 to be in an interruption state, acquire an output value of the ADC 50*b* (a value of a voltage applied to the resistance element R2) in a state where the switch SW4 is controlled to be in a conductive state, and acquire a temperature of the second load 31 as a temperature of the flavor source 33 based on the output value.

In a case of the circuit example shown in FIG. 8, the temperature detection unit controls the switch SW1 and the switch SW3 to be in an interruption state, acquires an output value of the ADC 50*c* (a value of a voltage applied to the first load 21) in a state where the switch SW2 is controlled to be in a conductive state, and acquires a temperature of the first load 21 based on the output value.

The notification control unit controls the notification unit 45 so as to notify various pieces of information. For example, the notification control unit controls the notification unit 45 so as to give a notification that prompts replacement of the second cartridge 30 in response to detection of a replacement timing of the second cartridge 30. The notification control unit is not limited to the notification that prompts the replacement of the second cartridge 30, and may give a notification that prompts replacement of the first cartridge 20, a notification that prompts replacement of the power supply 12, a notification that prompts charging of the power supply 12, and the like.

The power control unit controls discharging from the power supply 12 to at least the first load 21 (discharging required for heating a load) of the first load 21 and the second load 31 in response to a signal indicating the aerosol generation request output from the intake sensor 15.

In the case of the circuit example shown in FIG. 7, the power control unit controls the switch SW2, the switch SW3, and the switch SW4 to be in an interruption state, and controls the switch SW1 to be in a conductive state, so that discharging is performed from the power supply 12 to the first load 21 to atomize the aerosol source 22. Further, the power control unit controls the switch SW1, the switch SW2, and the switch SW4 to be in an interruption state and controls the switch SW3 to be in a conductive state, so that discharging is performed from the power supply 12 to the second load 31 to heat the flavor source 33.

In the case of the circuit example shown in FIG. 8, the power control unit controls the switch SW2 and the switch SW3 to be in an interruption state and controls the switch SW1 to be in a conductive state, so that discharging is performed from the power supply 12 to the first load 21 to atomize the aerosol source 22. Further, the power control unit controls the switch SW1 and the switch SW2 to be in an interruption state and controls the switch SW3 to be in a conductive state, so that discharging is performed from the power supply 12 to the second load 31 to heat the flavor source 33.

Accordingly, in the aerosol inhaler 1, the flavor source 33 can be heated by discharging to the second load 31. Therefore, if power discharged to the first load 21 is the same, the amount of the flavor component added to the aerosol can be increased by heating the flavor source 33 as compared with a case where the flavor source 33 is not heated.

A weight [mg] of an aerosol that is generated in the first cartridge 20 and passes through the flavor source 33 by one suction operation by the user is referred to as an aerosol weight $W_{aerosol}$. Power required to be supplied to the first load 21 for the generation of the aerosol is referred to as atomization power $P_{liquid}$. A time when the atomization power $P_{liquid}$ is supplied to the first load 21 for the generation of the aerosol is referred to as a supply time $t_{sense}$. An upper limit value of the supply time $t_{sense}$ is the first default value $t_{upper}$ described above per suction. A weight [mg] of a flavor component contained in the flavor source 33 is referred to as a flavor component remaining amount $W_{capsule}$. Information on a temperature of the flavor source 33 is referred to as a temperature parameter $T_{capsule}$. A weight [mg] of a flavor component added to the aerosol that passes through the flavor source 33 by one suction operation by the user is referred to as an amount of a flavor component $W_{flavor}$. Specifically, the information on the temperature of the flavor source 33 is a temperature of the flavor source 33 or the second load 31 acquired based on an output of the temperature detection element T1 (or the temperature detection element T3).

It is experimentally found that the amount of the flavor component $W_{flavor}$ depends on the flavor component remaining amount $W_{capsule}$, the temperature parameter $T_{capsule}$, and the aerosol weight $W_{aerosol}$. Therefore, the amount of the flavor component $W_{flavor}$ can be modeled by the following equation (1).

$$W_{flavor}=\beta\times(W_{capsule}\times T_{capsule})\times\gamma\times W_{aerosol} \quad (1)$$

The β in Equation (1) is a coefficient indicating a ratio of how much of the flavor component contained in the flavor source 33 is added to an aerosol in one suction, and is experimentally obtained. The γ in Equation (1) is a coefficient obtained experimentally. The temperature parameter $T_{capsule}$ and the flavor component remaining amount $W_{capsule}$ can fluctuate during a period in which one suction is performed, but in the model, the γ is introduced in order to handle the temperature parameter $T_{capsule}$ and the flavor component remaining amount $W_{capsule}$ as constant values.

The flavor component remaining amount $W_{capsule}$ is decreased every time suction is performed. Therefore, the flavor component remaining amount $W_{capsule}$ is inversely proportional to suction times that are times when the suction is performed (in other words, the cumulative number of times of operations of discharging to the first load 21 for aerosol generation in response to the aerosol generation request). Further, the flavor component remaining amount $W_{capsule}$ decreases more as a time during which discharging to the first load 21 is performed to generate an aerosol in response to suction is longer. Therefore, the flavor component remaining amount $W_{capsule}$ is also inversely proportional to a cumulative value of the time during which the discharging to the first load 21 is performed to generate the aerosol in response to the suction (hereinafter, referred to as cumulative discharging time).

As can be seen from the model of Equation (1), when it is assumed that the amount of the aerosol $W_{aerosol}$ for each suction is controlled to be substantially constant, it is necessary to increase the temperature of the flavor source 33 according to a decrease in the flavor component remaining amount $W_{capsule}$ (in other words, an increase in the suction times or the cumulative discharging time) in order to stabilize the amount of the flavor component $W_{flavor}$.

Therefore, the power control unit of the MCU 50 increases a target temperature of the flavor source 33 (a target temperature $T_{cap_target}$ described below) based on the suction times or the cumulative discharging time. Then, based on an output of the temperature detection element T1 (or the temperature detection element T3), the power control unit of the MCU 50 controls discharging for heating the flavor source 33 from the power supply 12 to the second load 31 such that the temperature of the flavor source 33 converges to the target temperature. Accordingly, it is possible to increase and stabilize the amount of the flavor component $W_{flavor}$. Specifically, the power control unit of the MCU 50 manages the target temperature according to a table stored in advance in the memory 50*a*. The table stores the suction times or the cumulative discharging time in association with the target temperature of the flavor source 33.

The MCU 50 causes the power supply unit 10 to operate in a plurality of operation modes in which a maximum power consumption amount, which is a peak value of a consumption amount of power stored in the power supply 12, is different. The plurality of operation modes include at least an activation mode in which the maximum power consumption amount is a first power consumption amount (a first mode) and a sleep mode (a second mode) in which the maximum power consumption amount is smaller than the first power consumption amount.

The sleep mode is a mode in which the maximum power consumption amount is the smallest when the power supply unit 10 is activated. For example, the MCU 50 changes an operation mode by increasing or decreasing the maximum power consumption amount by changing the number of hardware to be operated while the power supply unit 10 is turned on. For example, in the sleep mode, the MCU 50 controls the maximum power consumption amount to the minimum by stopping all hardware other than itself and disabling functions other than a function of detecting an operation of the operation unit 14 by itself. Further, in the activation mode, the MCU 50 causes all the hardware to operate as necessary.

The MCU 50 causes the power supply unit 10 to operate in the sleep mode when a period during which a signal indicating the aerosol generation request is not acquired (Hereinafter, referred to as a non-suction time) exceeds a predetermined sleep shifting time in the activation mode. The MCU 50 may make it possible to shift to the sleep mode at an appropriate timing by variably controlling the sleep shifting time based on a variable related to a state of the power supply unit 10, instead of setting the sleep shifting time to a single fixed value.

Figure 9:
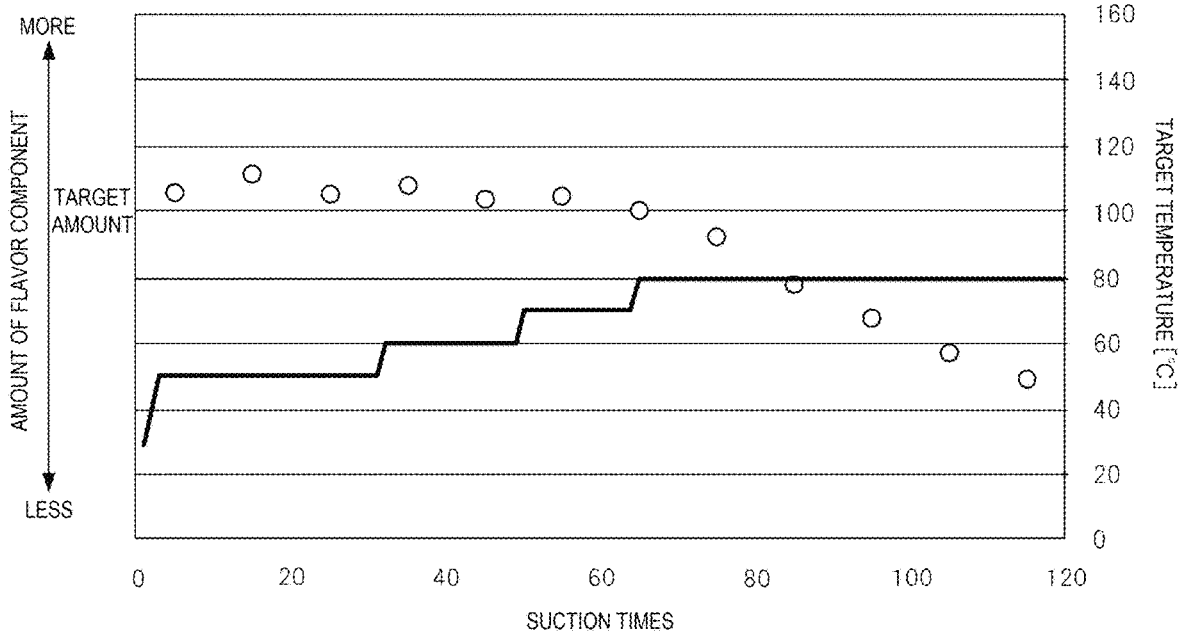
FIG. 9 is a diagram showing results obtained by calculating a target temperature of a flavor source such that an amount of a flavor component converges to a target amount, and measurement results of the amount of the flavor component when discharging control to a second load is performed based on the result.

FIG. 9 is a diagram showing examples of results obtained by calculating the target temperature of the flavor source 33 such that the amount of the flavor component $W_{flavor}$ converges to the target amount, and examples of measurement results of the amount of the flavor component $W_{flavor}$ when discharging control for the second load 31 is performed for heating the flavor source 33 based on the result. FIG. 9 shows results when a total of 120 suctions are performed, assuming that a time per suction is 2.4 seconds.

A horizontal axis in FIG. 9 indicates the suction times. A vertical axis on a right side of FIG. 9 indicates the target temperature of the flavor source 33. A vertical axis on a left side of FIG. 9 indicates the amount of the flavor component added to the aerosol by one suction. In FIG. 9, the amount of the flavor component when each N-th suction (N is a multiple of five) is performed is plotted as an experimental result. A thick solid line shown in FIG. 9 indicates a calculation result of the target temperature. The horizontal axis in FIG. 9 can be replaced with the cumulative discharging time by multiplying the suction times by 2.4 seconds.

According to a profile of the target temperature shown in FIG. 9, the amount of the flavor component for each suction can be substantially set to the target amount until a suction in the vicinity of 80 times. Accordingly, even for a user who repeats standard suction of 2.4 seconds, a large amount of a flavor component can be provided up to 80 suctions. Further, even when the suction is performed over 80 times, a larger amount of the flavor component can be provided as compared with a case where the flavor source is not heated.

(Operations of Aerosol Inhaler)

Figure 10:
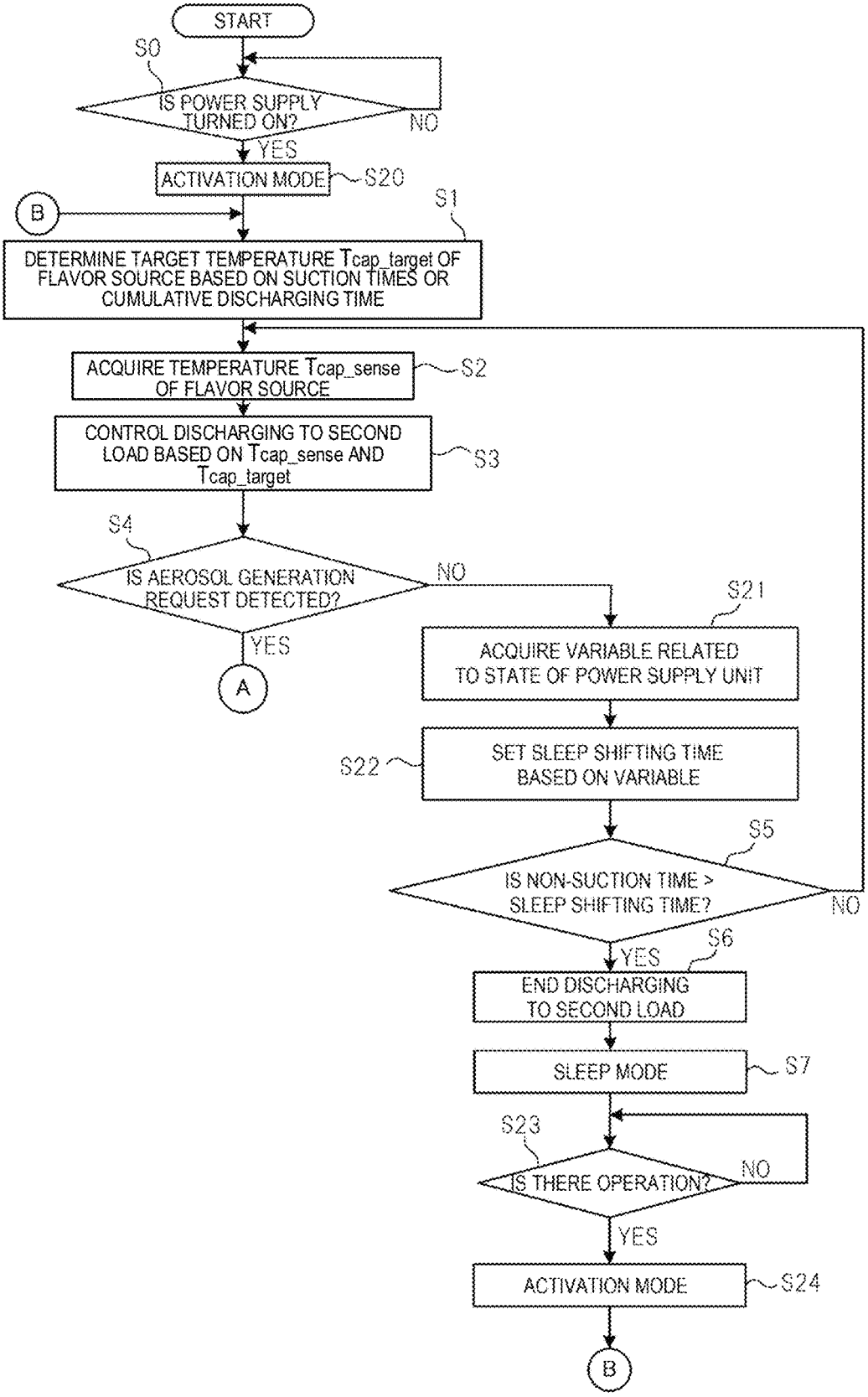
FIG. 10 is a flowchart for illustrating operations of the aerosol inhaler of FIG. 1.
Figure 11:
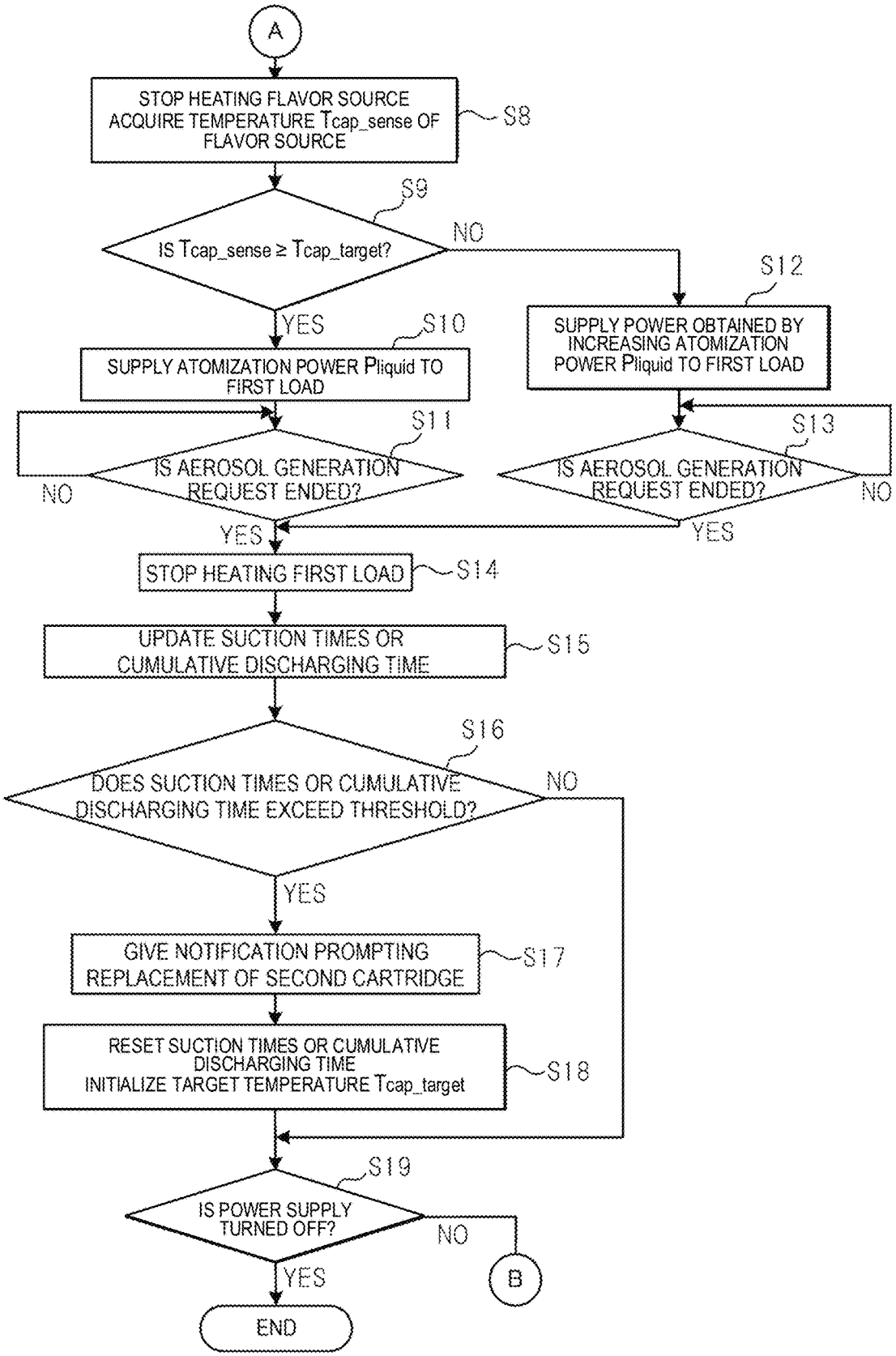
FIG. 11 is a flowchart for illustrating operations of the aerosol inhaler of FIG. 1.

FIGS. 10 and 11 are flowcharts for illustrating operations of the aerosol inhaler 1 of FIG. 1. When the power supply of the aerosol inhaler 1 is turned on by an operation of the operation unit 14 or the like (Step S0: YES), the MCU 50 causes the power supply unit 10 to operate in the activation mode (Step S20). Then, the MCU 50 determines (sets) the target temperature $T_{cap_target}$ of the flavor source 33 based on the suction times or the cumulative discharging time stored in the memory 50*a* (Step S1).

Next, the MCU 50 acquires the current temperature $T_{cap_sense}$ of the flavor source 33 based on an output of the temperature detection element T1 (or the temperature detection element T3) (Step S2).

Next, the MCU 50 controls discharging to the second load 31 for heating the flavor source 33 based on the temperature $T_{cap_sense}$ and the target temperature $T_{cap_target}$ (Step S3). Specifically, the MCU 50 supplies power to the second load 31 by proportional-integral-differential (PID) control or ON/OFF control such that the temperature $T_{cap_sense}$ converges to the target temperature $T_{cap_target}$.

In the PID control, a difference between the temperature $T_{cap_sense}$ and the target temperature $T_{cap_target}$ is fed back, and based on the feedback result, power control is performed such that the temperature $T_{cap_sense}$ converges to the target temperature $T_{cap_target}$. According to the PID control, the temperature $T_{cap_sense}$ can converge to the target temperature $T_{cap_target}$ with high accuracy. The MCU 50 may use proportional (P) control or proportional-integral (PI) control instead of the PID control.

The ON/OFF control is control in which when the temperature $T_{cap_sense}$ is lower than the target temperature $T_{cap_target}$, power is supplied to the second load 31, and when the temperature $T_{cap_sense}$ is equal to or higher than the target temperature $T_{cap_target}$, the power supply to the second load 31 is stopped until the temperature $T_{cap_sense}$ is lower than the target temperature $T_{cap_target}$. According to the ON/OFF control, the temperature of the flavor source 33 can be increased faster than that in the PID control. Therefore, it is possible to increase a possibility that the temperature $T_{cap_sense}$ reaches the target temperature $T_{cap_target}$ at a stage before the aerosol generation request described later is detected. The target temperature $T_{cap_target}$ may have hysteresis.

After Step S3, the MCU 50 determines whether there is the aerosol generation request (Step S4). When the aerosol generation request is detected (Step S4: YES), the MCU 50 ends discharging to the second load 31 for heating the flavor source 33, and acquires the temperature $T_{cap_sense}$ of the flavor source 33 at that time based on an output of the temperature detection element T1 (or the temperature detection element T3) (Step S8). Then, the MCU 50 determines whether the temperature $T_{cap_sense}$ acquired in Step S8 is equal to or higher than the target temperature $T_{cap_target}$ (Step S9).

When the temperature $T_{cap_sense}$ is equal to or higher than the target temperature $T_{cap_target}$ (Step S9: YES), the MCU 50 supplies the predetermined atomization power $P_{liquid}$ to the first load 21 to start heating the first load 21 (heating for atomizing the aerosol source 22) (Step S10). After the heating of the first load 21 is started in Step S10, the MCU 50 continues the heating when the aerosol generation request is not ended (Step S11: NO), and stops power supply to the first load 21 when the aerosol generation request is ended (Step S11: YES) (Step S14).

When the temperature $T_{cap_sense}$ is lower than the target temperature $T_{cap_target}$ (Step S9: NO), the MCU 50 supplies power obtained by increasing the atomization power $P_{liquid}$ by a predetermined amount to the first load 21 to start heating the first load 21 (Step S12). The increase in the power here is performed according to, for example, a table in which a temperature difference between the temperature $T_{cap_sense}$ and the target temperature $T_{cap_target}$ and a power increase amount are associated with each other. After the heating of the first load 21 is started in Step S12, the MCU 50 continues the heating when the aerosol generation request is not ended (Step S13: NO), and stops power supply to the first load 21 when the aerosol generation request is ended (Step S13: YES) (Step S14).

Accordingly, even when the temperature of the flavor source 33 does not reach the target temperature at a time point at which the aerosol generation request is made, by performing the processing of Step S12, an amount of a generated aerosol can be increased. As a result, a decrease in an amount of a flavor component added to an aerosol due to the temperature of the flavor source 33 being lower than the target temperature can be compensated for by an increase in the amount of the aerosol. Therefore, the amount of the flavor component added to the aerosol can converge to the target amount.

After Step S14, the MCU 50 updates the suction times or the cumulative discharging time stored in the memory 50*a* (Step S15).

Next, the MCU 50 determines whether the updated suction times or cumulative discharging time exceeds a threshold (Step S16). When the updated suction times or cumulative discharging time is equal to or smaller than the threshold (Step S16: NO), the MCU 50 shifts the processing to Step S19. When the updated suction times or cumulative discharging time exceeds the threshold (Step S16: YES), the MCU 50 causes the notification unit 45 to give a notification that prompts replacement of the second cartridge 30 (Step S17). Then, the MCU 50 resets the suction times or the cumulative discharging time to an initial value (=0) and initializes the target temperature $T_{cap_target}$ (Step S18). The initialization of the target temperature $T_{cap_target}$ means excluding a target temperature $T_{cap_target}$ at that time point stored in the memory 50*a* from a set value.

After Step S18, the MCU 50 returns the processing to Step S1 if the power supply is not turned off (Step S19: NO) and ends the processing when the power supply is turned off (Step S19: YES).

In Step S4, when the aerosol generation request is not detected (Step S4: NO), the MCU 50 acquires a variable related to a state of the power supply unit 10 (Step S21) and sets the sleep shifting time based on the variable (Step S22). Further, in Step S5, the MCU 50 determines a length of the period (the non-suction time) during which the aerosol generation request is not made. When the non-suction time exceeds the sleep shifting time set in Step S22 (Step S5: YES), the MCU 50 ends discharging to the second load 31 (Step S6) to cause the power supply unit 10 to operate in the sleep mode (Step S7). When the non-suction time is equal to or shorter than the sleep shifting time (Step S5: NO), the MCU 50 shifts the processing to Step S2.

After Step S7, the MCU 50 monitors presence or absence of an operation of the operation unit 14. When there is the operation (Step S23: YES), the MCU 50 returns the operation mode of the power supply unit 10 to the activation mode (Step S24) and shifts the processing to Step S1.

For example, there are the following three methods for setting the sleep shifting time in Step S22.

(First Setting Method)

In this method, a variable Pb indicating a state of the power supply 12 is used as the variable related to the state of the power supply unit 10. The variable Pb is, for example, a state of charge (SOC) indicating a voltage of the power supply 12 or a remaining amount of the power supply 12, or the like. Hereinafter, it is assumed that the larger the variable Pb, the larger the amount of power that the power supply 12 can discharge. A maximum value of the sleep shifting time is predetermined, and the maximum value is hereinafter referred to as a predetermined time TM1.

The MCU 50 determines a first value (a subtraction amount) to be subtracted from the predetermined time TM1 based on the variable Pb, and sets a time obtained by subtracting the determined value from the predetermined time TM1 as the sleep shifting time.

Figure 12:
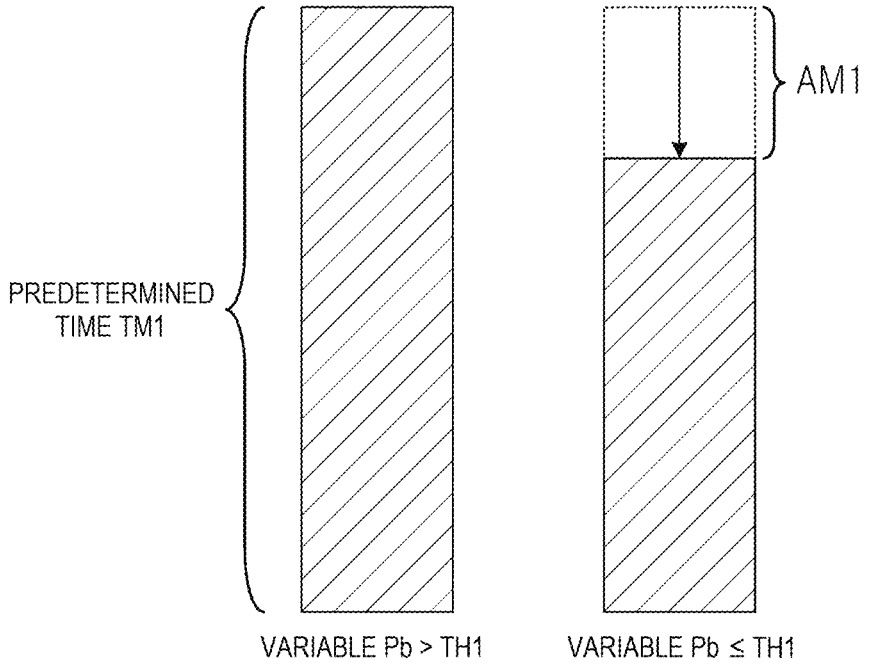
FIG. 12 is a schematic diagram for illustrating a method for setting a sleep shifting time.

For example, as shown in FIG. 12, when the variable Pb exceeds a threshold TH1, the MCU 50 sets the subtraction amount to 0 and sets the predetermined time TM1 as it is as the sleep shifting time. When the variable Pb is equal to or smaller than the threshold TH1, the MCU 50 sets the subtraction amount to a value AM1 and sets a time obtained by subtracting the value AM1 from the predetermined time TM1 as the sleep shifting time.

As the variable Pb becomes smaller, the subtraction amount is increased. The predetermined time TM1 may be subtracted to the value AM1 at maximum in a plurality of stages according to a size of the variable Pb, and the sleep shifting time may be shortened according to a decrease in the variable Pb.

In this method, when the voltage of the power supply 12 is low or the remaining amount is small, a time before shifting to the sleep mode is performed is shortened as compared with a case where the voltage of the power supply 12 is high or the remaining amount is large. In other words, when the voltage of the power supply 12 is low or the remaining amount is small, the MCU 50 causes the power supply unit 10 to shift to the sleep mode at a timing before the predetermined time TM1 (the maximum value of the sleep shifting time) elapses. Accordingly, when the voltage of the power supply 12 is low or the remaining amount is small, by shortening a time before shifting to the sleep mode is performed, it is possible to shift to the sleep mode at an earlier stage, and power consumption can be reduced.

(Second Setting Method)

In this method, a variable Pt that is a parameter correlated with electric energy discharged to the second load 31 is used as the variable related to the state of the power supply unit 10. The variable Pt is the target temperature $T_{cap_target}$ determined in Step S1. The higher the target temperature $T_{cap_target}$, the larger the power consumption required for maintaining the temperature of the flavor source 33 at the target temperature $T_{cap_target}$. Therefore, the higher the target temperature $T_{cap_target}$, the shorter the time before shifting to the sleep mode is performed, so that it is possible to prevent consumption of a large amount of power for maintaining the temperature of the flavor source 33 at the target temperature.

Specifically, the MCU 50 determines a second value (a subtraction amount) to be subtracted from the predetermined time TM1 based on the variable Pt, and sets a time obtained by subtracting the determined value from the predetermined time TM1 as the sleep shifting time.

Figure 13:
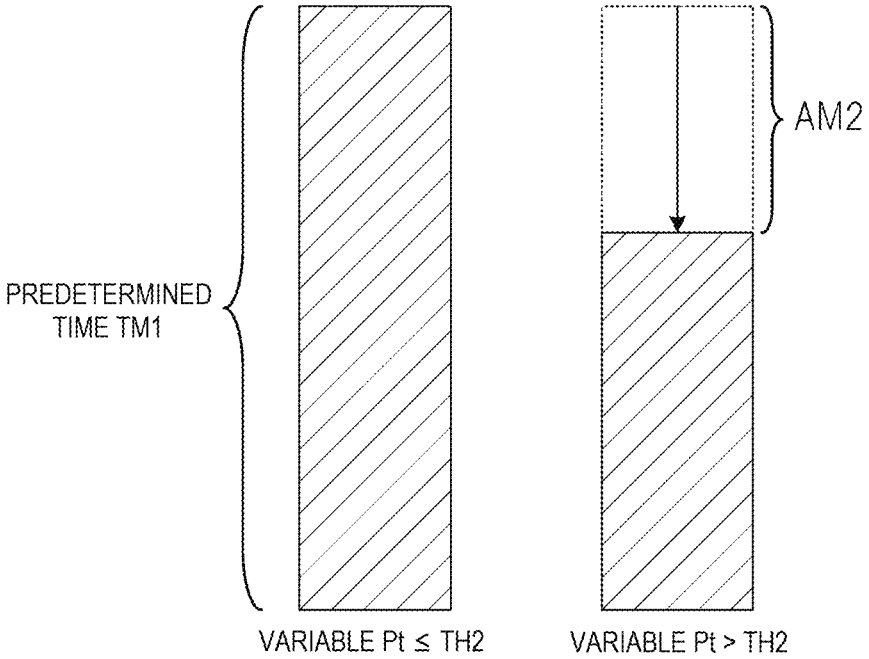
FIG. 13 is a schematic diagram for illustrating a method for setting a sleep shifting time.

For example, as shown in FIG. 13, when the variable Pt is equal to or smaller than a threshold TH2, the MCU 50 sets the subtraction amount to 0 and sets the predetermined time TM1 as it is as the sleep shifting time. When the variable Pt exceeds the threshold TH2, the MCU 50 sets the subtraction amount to a value AM2, and sets a time obtained by subtracting the value AM2 from the predetermined time TM1 as the sleep shifting time.

The subtraction amount may be increased as the variable Pt becomes larger, the predetermined time TM1 may be subtracted to the value AM2 at maximum in a plurality of stages according to a size of the variable Pt, and the sleep shifting time may be shortened according to an increase in the variable Pt.

In the second setting method, a temperature difference between the target temperature $T_{cap_target}$ and an outside air temperature (an ambient temperature of the power supply unit 10) may be used as the variable Pt instead of the target temperature $T_{cap_target}$. The outside air temperature can be acquired by a temperature sensor built in the MCU 50, a temperature sensor included in the intake sensor 15, or the like.

If the target temperature $T_{cap_target}$ is close to the outside air temperature, power consumption required for maintaining the temperature of the flavor source 33 at the target temperature $T_{cap_target}$ is small. On the other hand, when the target temperature $T_{cap_target}$ is much higher than the outside air temperature, the power consumption required for maintaining the temperature of the flavor source 33 at the target temperature $T_{cap_target}$ increases. Therefore, the larger the temperature difference, the larger the above subtraction amount, and the shorter the time before shifting to the sleep mode is performed, so that it is possible to prevent consumption of a large amount of power for maintaining the temperature of the flavor source 33 at the target temperature.

There is also an opposite way of thinking. If the target temperature $T_{cap_target}$ is close to the outside air temperature, power consumption required for causing the temperature of the flavor source 33 to converge to the target temperature $T_{cap_target}$ is small after the activation mode is returned after shifting to the sleep mode. Therefore, the larger the temperature difference, the smaller the above subtraction amount, and the longer the time before shifting to the sleep mode is performed, so that the temperature of the flavor source 33 can converge to the target temperature at a high speed after returning from the sleep mode to the activation mode.

In these methods, based on the variable Pt, the MCU 50 can cause the power supply unit 10 to shift to the sleep mode at a timing before the predetermined time TM1 (the maximum value of the sleep shifting time) elapses.

(Third Setting Method)

The MCU 50 sets the sleep shifting time based on the variable Pb and the variable Pt described above. Specifically, the MCU 50 determines a first value (a first subtraction amount) to be subtracted from the predetermined time TM1 based on the variable Pb, determines a second value (a second subtraction amount) to be subtracted from the predetermined time TM1 based on the variable Pt, and sets a time obtained by subtracting the first subtraction amount and the second subtraction amount from the predetermined time TM1 as the sleep shifting time.

In this case, it is preferable to determine maximum values such that a sum of a maximum value of the first subtraction amount (the value AM1 in FIG. 12) and a maximum value of the second subtraction amount (the value AM2 in FIG. 13) is less than the predetermined time TM1. In this way, the sleep shifting time (the difference between the predetermined time TM1 and the sum of the first subtraction amount and the second subtraction amount) has a value larger than "0" regardless of a value of the variable. Therefore, it is possible to improve usability of the aerosol inhaler 1 by eliminating shifting to the sleep mode at an extremely early time.

According to this method, a timing of shifting to the sleep mode can be individually adjusted with a plurality of variables. Therefore, even when the plurality of variables are used, it is possible to appropriately manage the timing of shifting to the sleep mode while avoiding a conflict.

As described above, according to the aerosol inhaler 1, even when a state where the aerosol generation request is not made does not continue to exceed the predetermined time TM1, since shifting to the sleep mode is enabled, power consumption can be reduced. Therefore, more power can be discharged to the first load 21 and the second load 31 when the aerosol generation request is made. As a result, it is possible to provide the user with a sufficient amount of aerosol and flavor component, and a commercial value of the aerosol inhaler can be increased.

Modification of Embodiment

In the above description, the MCU 50 variably controls the sleep shifting time, but in this modification, the sleep shifting time is set to a single value ("6 minutes" in an example described later). Further, the MCU 50 causes the power supply unit 10 to operate in any one of operation modes including a power-saving mode (a third mode), an activation mode, and a sleep mode. In the power-saving mode (the third mode), a maximum power consumption amount is smaller than that in the activation mode and the maximum power consumption amount is larger than that in the sleep mode.

Specifically, the MCU 50 causes the power supply unit 10 to operate in the activation mode after the power supply is turned on. Then, in the activation mode, the MCU 50 causes the power supply unit 10 to operate in the power-saving mode at a timing before a non-suction time exceeds the sleep shifting time. When the non-suction time is further continued and exceeds the sleep shifting time, the MCU 50 causes the power supply unit 10 to operate in the sleep mode. Hereinafter, details of operations of the aerosol inhaler 1 of the modification will be described. Hereinafter, an example in which the power-saving mode is configured with a first power-saving mode and a second power-saving mode in which a maximum power consumption amount is smaller than that in the first power-saving mode will be described.

Figure 14:
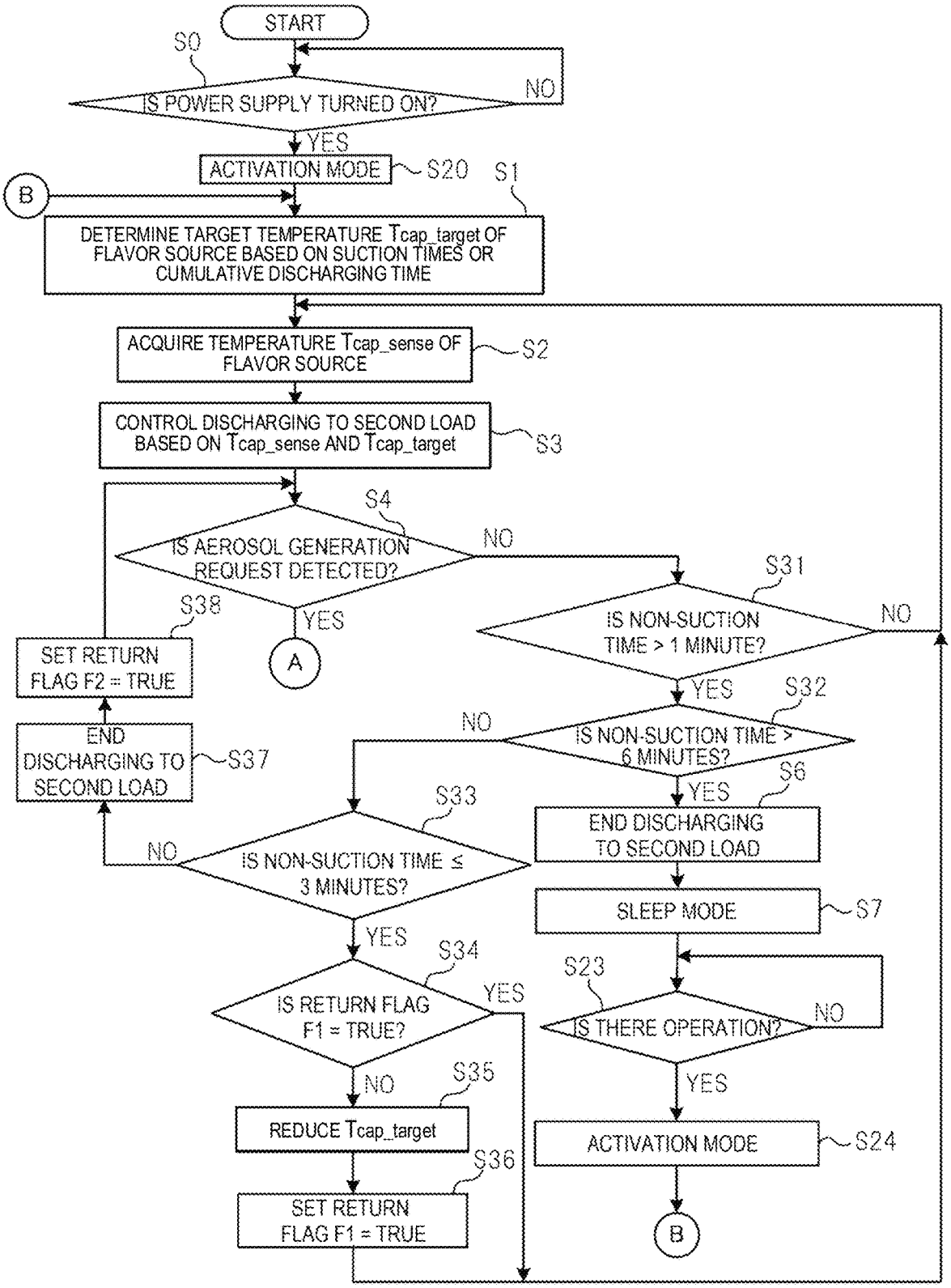
FIG. 14 is a flowchart for illustrating operations of a modification of the aerosol inhaler of FIG. 1.
Figure 15:
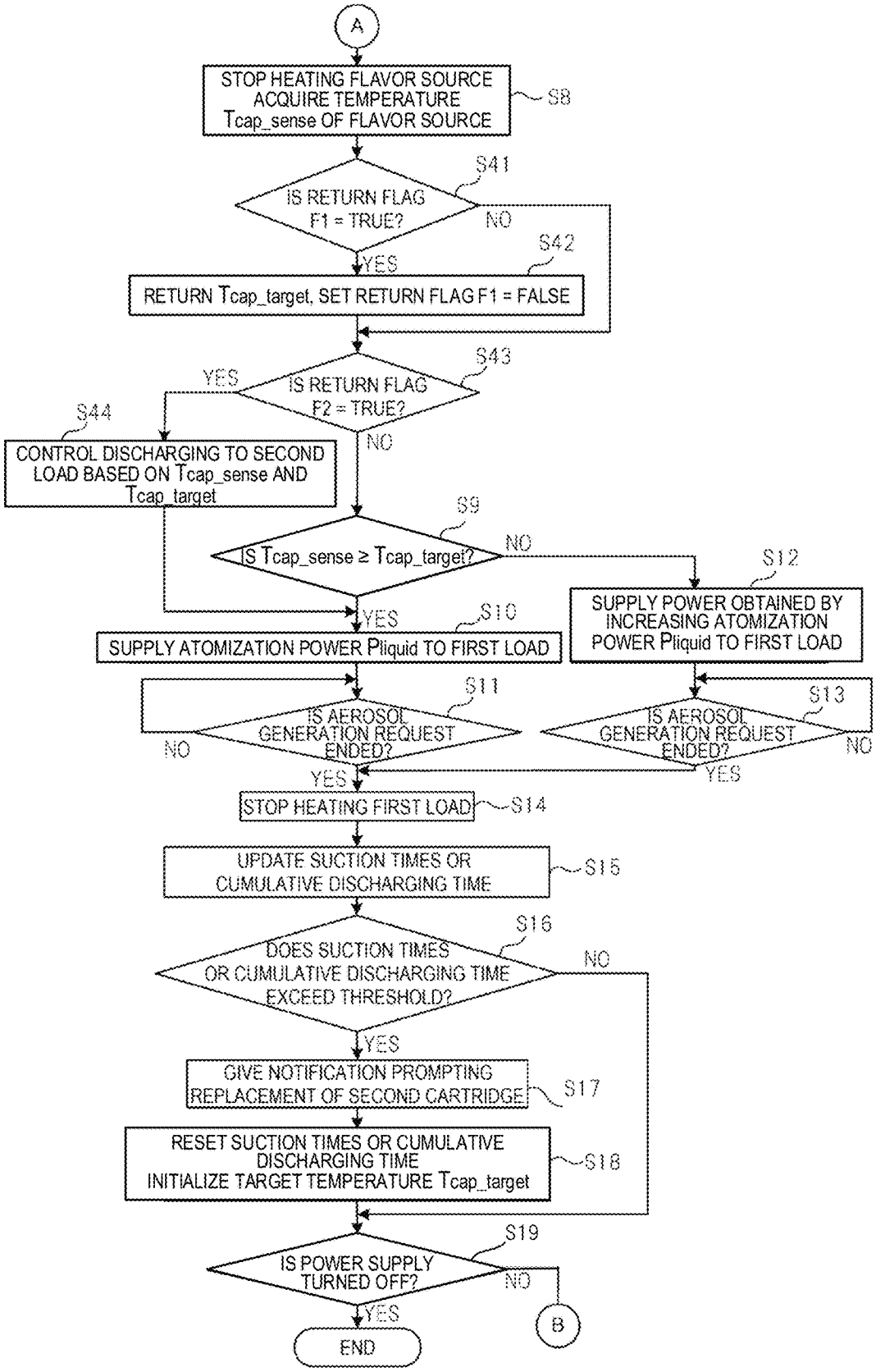
FIG. 15 is a flowchart for illustrating operations of the modification of the aerosol inhaler of FIG. 1.

FIGS. 14 and 15 are flowcharts for illustrating the modification of the operations of the aerosol inhaler 1 of FIG. 1. In FIGS. 14 and 15, the same processings as those in FIGS. 10 and 11 are designated by the same reference numerals and description thereof will be omitted. A sleep shifting time (=6 minutes) and thresholds (1 minute, 3 minutes) to be compared with the sleep shifting time described below are examples, and the present invention is not limited thereto.

When a determination in Step S4 is NO, the MCU 50 determines whether the non-suction time exceeds the first threshold (=1 minute) smaller than the sleep shifting time (=6 minutes) (Step S31). When the non-suction time is 1 minute or less (Step S31: NO), the MCU 50 returns the processing to Step S2.

When the non-suction time exceeds 1 minute (Step S31: YES), the MCU 50 determines whether the non-suction time exceeds 6 minutes (Step S32). When the non-suction time exceeds 6 minutes (Step S32: YES), the MCU 50 performs processings in Step S6 and Steps after Step S6.

When the non-suction time is 6 minutes or less (Step S32: NO), the MCU 50 determines whether the non-suction time is equal to or smaller than the second threshold (=3 minutes) that is smaller than 6 minutes and larger than the first threshold (Step S33).

When the non-suction time is 3 minutes or less (Step S33: YES), the MCU 50 determines whether a return flag F1 is TRUE (Step S34).

The return flag F1 is a flag used to determine whether an operation mode of the power supply unit 10 is the first power-saving mode. A state where the return flag F1 is TRUE means that the power supply unit 10 operates in the first power-saving mode. A state where the return flag F1 is FALSE means that the power supply unit 10 operates in an operation mode other than the first power-saving mode.

When the return flag F1 is FALSE (Step S34: NO), the MCU 50 reduces the target temperature $T_{cap_target}$ determined in Step S1 (Step S35), sets the return flag F1 to TRUE (Step S36), and returns the processing to Step S2. When the return flag F1 is TRUE (Step S34: YES), the MCU 50 omits the processings in Steps S35 and S36 and returns the processing to Step S2.

By the processing of Step S35, power discharged to the second load 31 for heating the flavor source 33 is smaller than that before the processing is performed. That is, since the processing of Step S35 is performed, an operation mode of the power supply unit 10 is shifted from the activation mode to the first power-saving mode in which the maximum power consumption amount is smaller than that in the activation mode. Therefore, in Step S36, the return flag F1 is set to TRUE indicating that the power supply unit 10 is in operation in the first power-saving mode.

When the non-suction time exceeds 3 minutes (Step S33: NO), the MCU 50 ends the discharging to the second load 31 for heating the flavor source 33 (Step S37), sets a return flag F2 to TRUE (Step S38), and returns the processing to Step S4.

The return flag F2 is a flag used to determine whether an operation mode of the power supply unit 10 is the second power-saving mode. A state where the return flag F2 is TRUE means that the power supply unit 10 operates in the second power-saving mode. A state where the return flag F2 is FALSE means that the power supply unit 10 operates in an operation mode other than the second power-saving mode.

When the determination in Step S33 is NO, the processing in Step S37 is performed and the discharging to the second load 31 is stopped. Therefore, a maximum power consumption amount of the power supply unit 10 is smaller than that in the activation mode in which the second load 31 can be discharged and the first power-saving mode. That is, when the determination in Step S33 is NO, the MCU 50 causes the power supply unit 10 to operate in the second power-saving mode. Therefore, in Step S38, the return flag F2 is set to TRUE indicating that the power supply unit 10 is in operation in the second power-saving mode.

Accordingly, in a state where the non-suction time is 1 minute or less, the power supply unit 10 operates in the activation mode. When the non-suction time increases from this state to a state of more than 1 minute and 3 minutes or less, the power supply unit 10 operates in the first power-saving mode in which the maximum power consumption amount is smaller than that in the activation mode. Further, when the non-suction time increases from this state to a state where 3 minutes are exceeded, the power supply unit 10 operates in the second power-saving mode in which the maximum power consumption amount is smaller than that in the first power-saving mode. Then, when the non-suction time further increases and exceeds 6 minutes, the power supply unit 10 operates in the sleep mode.

In Step S35, the MCU 50 preferably decreases the target temperature of the flavor source 33 by a temperature of 5° C. or higher and 15° C. or lower. In order to cause the temperature of the flavor source 33 to converge to the target temperature, it is necessary to acquire the temperature of the flavor source 33 with a resolution finer than a decrement of the target temperature. The decrement of the target temperature is set to a value of 5° C. or higher and 15° C. or lower, so that an acquisition resolution of the temperature of the flavor source 33 can be set to 5° C. or higher. Therefore, a cost required for acquiring the temperature of the flavor source 33 can be reduced.

In Step S35, the target temperature of the flavor source 33 may be decreased by a temperature of 5 times or more and 15 times or less of the acquisition resolution of the temperature of the flavor source 33. Setting the acquisition resolution of the temperature of the flavor source 33 less than 1° C. may lead to an increase in cost. Since the decrement of the target temperature is set to the value of 5 times or more and 15 times or less of the acquisition resolution, the decrement (a value of 5° C. or higher and 15° C. or lower) of the target temperature described above can be achieved without increasing the cost required for acquiring the temperature of the flavor source 33.

When the determination in Step S33 is YES, the MCU 50 may change the decrement of the target temperature $T_{cap_target}$ according to a length of the non-suction time. Specifically, the MCU 50 increases the decrement as the non-suction time increases. In this way, the second power-saving mode can be further subdivided to gradually reduce power consumption amount.

When the determination in Step S4 is YES, the MCU 50 performs the processing in Step S8. After Step S8, the MCU 50 determines whether the return flag F1 is TRUE (Step S41). When the return flag F1 is TRUE (Step S41: YES), the MCU 50 returns the target temperature $T_{cap_target}$ decreased in the first power-saving mode to the value determined in Step S1, sets the return flag F1 to FALSE (Step S42), and shifts the processing to Step S43. When the return flag F1 is FALSE (Step S41: NO), the MCU 50 shifts the processing to Step S43.

In Step S43, the MCU 50 determines whether the return flag F2 is TRUE (Step S43). When the return flag F2 is TRUE (Step S43: YES), the MCU 50 controls discharging to the second load 31 for heating the flavor source 33 based on the temperature $T_{cap_sense}$ acquired in Step S8 and the target temperature $T_{cap_target}$ determined in Step S1 (Step S44), and shifts the processing to Step S10. In Step S44, the MCU 50 supplies power to the second load 31 by the PID control (PD control or P control) or the ON/OFF control such that the temperature $T_{cap_sense}$ converges to the target temperature $T_{cap_target}$.

When the determination in Step S43 is YES, the heating of the flavor source 33 is stopped in a stage before the aerosol generation request is made. In this case, the temperature of the flavor source 33 may be lower than the target temperature. Therefore, a desired amount of the flavor component can be added to the aerosol by performing the processing in Step S44.

When the return flag F2 is FALSE (Step S43: NO), the MCU 50 compares the temperature $T_{cap_sense}$ acquired in Step S8 with the target temperature $T_{cap_target}$ determined in Step S1 in Step S9. If the temperature $T_{cap_sense}$ is equal to or higher than the target temperature $T_{cap_target}$ (Step S9: YES), the MCU 50 performs the processing in Step S10. If the temperature $T_{cap_sense}$ is lower than the target temperature $T_{cap_target}$ (Step S9: NO), the MCU 50 performs the processing in Step S12.

When the determination in Step S43 is YES and the processing in Step S44 is performed, it is necessary to perform both discharging to the first load 21 for generating the aerosol and discharging to the second load 31 for causing the temperature of the flavor source 33 to converge to the target temperature.

In this case, the first load 21 and the second load 31 may be discharged at the same time such that the flavor source 33 and the aerosol source 22 are heated in parallel. Accordingly, an aerosol to which the desired amount of the flavor component is added can be efficiently generated.

In this case, the first load 21 and the second load 31 may be alternately discharged (in other words, discharging to the first load 21 is performed in a period during which discharging to the second load 31 is stopped, and the discharging to the second load 31 is performed in a period during which the discharging to the first load 21 is stopped). Accordingly, deterioration of the power supply 12 due to a large current being discharged from the power supply 12 can be prevented.

According to the above modification, the power supply unit 10 can operate in the power-saving mode in which the maximum power consumption amount is smaller than that in the activation mode before an operation mode of the power supply unit 10 is shifted to the sleep mode. Therefore, power consumption can be reduced. Particularly, since discharging to the second load 31 is stopped in the second power-saving mode, power consumption can be fairly reduced. Further, the target temperature is lower in the first power-saving mode than that in the activation mode. Therefore, while reducing power consumption, an increase in the amount of the flavor component contained in the aerosol can be implemented by heating the flavor source 33.

According to the modification, even when the target temperature of the flavor source 33 is lowered in the first power-saving mode, the target temperature is raised in Step S42 when the aerosol is generated. Therefore, even when the target temperature is lowered for power saving, a reduction in the amount of the flavor component contained in the aerosol can be prevented.

According to the modification, when the aerosol generation request is detected in a state where the return flag F1 is TRUE and the return flag F2 is FALSE, the determination in Step S9 is NO due to an influence of the target temperature being lowered in the first power-saving mode, as compared with a case where the aerosol generation request is detected in a state where the return flag F1 is FALSE and the return flag F2 is FALSE (that is, the activation mode). Therefore, when the aerosol generation request is detected in the first power-saving mode, power discharged from the power supply 12 to the first load 21 for aerosol generation is increased compared with power discharged from the power supply 12 to the first load 21 for aerosol generation when the aerosol generation request is detected in the activation mode. Therefore, even when the target temperature is lowered for power saving, the reduction in the amount of the flavor component contained in the aerosol can be prevented.

When the aerosol generation request is detected in a state where the return flag F1 is TRUE and the return flag F2 is FALSE, the target temperature may be maintained as it is without being returned to an original temperature in Step S42. In this case, the temperature of the flavor source 33 is lower than a desired value. Therefore, power supplied to the first load 21 may be increased as compared with power discharged from the power supply 12 to the first load 21 for aerosol generation when the aerosol generation request is detected in the activation mode, such that the amount of the flavor component added to the aerosol becomes the target amount.

According to the modification, in a state before shifting to the sleep mode, the maximum power consumption amount is reduced in an order of the activation mode, the first power-saving mode, and the second power-saving mode according to the non-suction time. Therefore, power consumption can be reduced even before shifting to the sleep mode.

In FIG. 14, Steps S33 to S36 may be deleted, and the processing in Step S37 may be performed when the determination in Step S32 is NO. In this case, in FIG. 15, Steps S41 and S42 may be deleted and the processing in Step S43 may be performed after Step S8. Even in such a case, in a state before shifting to the sleep mode, the maximum power consumption amount is reduced in an order of the activation mode and the second power-saving mode according to the non-suction time. Therefore, power consumption can be reduced even before shifting to the sleep mode.

Alternatively, in FIG. 14, Steps S33, S37, and S38 may be deleted, and the processing in Step S34 may be performed when the determination in Step S32 is NO. In this case, in FIG. 15, Steps S43 and S44 may be deleted, and the processing in Step S9 may be performed after Step S41 or Step S42. Even in such a case, in a state before shifting to the sleep mode, the maximum power consumption amount is reduced in an order of the activation mode and the first power-saving mode according to the non-suction time. Therefore, power consumption can be reduced even before shifting to the sleep mode.

In the above embodiment and modifications, the first load 21 and the second load 31 are heaters that generate heat by power discharged from the power supply 12, but the first load 21 and the second load 31 may be Peltier elements that can perform both heat generation and cooling by the power discharged from the power supply 12. If the first load 21 and the second load 31 are configured in this way, a degree of freedom of control related to the temperature of the aerosol source 22 and the temperature of the flavor source 33 is increased, so that the amount of the flavor component can be more highly controlled.

Further, the first load 21 may be configured with an element that can atomize the aerosol source 22 without heating the aerosol source 22 by ultrasonic waves or the like. Further, the second load 31 may be configured with an element that can change the amount of the flavor component added to the aerosol by the flavor source 33 without heating the flavor source 33 by the ultrasonic waves or the like.

An element that can be used for the first load 21 is not limited to the heater, the Peltier element, and the ultrasonic wave element described above, and various elements or combinations thereof can be used as long as the element can atomize the aerosol source 22 by consuming power supplied from the power supply 12. Similarly, an element that can be used for the second load 31 is not limited to the heater, the Peltier element, and the ultrasonic wave element described above, and various elements or combinations thereof can be used as long as the element can change the amount of the flavor component added to the aerosol by consuming the power supplied from the power supply 12.

In the above description, the MCU 50 controls discharging from the power supply 12 to the first load 21 and the second load 31 such that the amount of the flavor component $W_{flavor}$ converges to the target amount. The target amount is not limited to a specific value and may be a range having a certain width.

In the above description, the flavor source 33 can be heated by the second load 31, but this configuration is not essential. The aerosol inhaler 1 may generate the aerosol to which the flavor component is added only by the first load 21. Even in this case, the MCU 50 can reduce power consumption by making a timing variable at which an operation mode of the power supply unit 10 is shifted from the activation mode to the sleep mode. Further, the MCU 50 can reduce power consumption by shifting an operation mode of the power supply unit 10 to at least one power-saving mode before shifting the operation mode of the power supply unit 10 from the activation mode to the sleep mode.

At least the following matters are described in the present description. Corresponding components in the above-described embodiments are shown in parentheses, without being limited thereto.

(1) A power supply unit (a power supply unit 10) for an aerosol inhaler (an aerosol inhaler 1) including a power supply (a power supply 12) configured to be dischargeable to a load (at least one of a first load 21 and a second load 31) configured to heat an aerosol generation source, a first sensor (an intake sensor 15) configured to output a signal indicating an aerosol generation request, and a processing device (an MCU 50) configured to acquire the signal from the first sensor, in which the processing device causes the power supply unit to operate in a first mode (an activation mode) in which a maximum power consumption amount is a first power consumption amount and a second mode (a sleep mode) in which a maximum power consumption amount is smaller than the first power consumption amount, and causes the power supply unit to operate in the second mode when a period (a non-suction time) during which the signal is not acquired exceeds a predetermined time (a predetermined time TM1) in the first mode, and in which the processing device causes the power supply unit to operate such that a maximum power consumption amount is less than the first power consumption amount at a timing before the period exceeds the predetermined time in the first mode.

According to (1), even when a state where the aerosol generation request is not made does not continue to exceed the predetermined time, power consumption can be reduced. Therefore, more power can be discharged to the load when the aerosol generation request is made. As a result, a sufficient amount of aerosol can be provided to a user, and a commercial value of the aerosol inhaler can be increased.

(2) The power supply unit according to (1), in which the processing device is configured to cause the power supply unit to operate in the second mode at the timing, and determines a timing at which the power supply unit is shifted to the second mode based on a variable related to a state of the power supply unit.

According to (2), shifting to the second mode can be performed at an appropriate timing according to a state of the power supply unit. Therefore, power consumption of the aerosol inhaler can be improved as compared with a case where shifting to the second mode is performed at a uniform timing regardless of a state of the power supply unit.

(3) The power supply unit according to (2), in which the variable is a voltage of the power supply or a remaining amount (SOC) of the power supply.

According to (3), a timing of shifting to the second mode is determined based on a state of the power supply. For example, in a state where the voltage of the power supply is low or the remaining amount of the power supply is small, the timing of shifting to the second mode is advanced as compared with a state where the voltage of the power supply is high or the remaining amount of the power supply is large, so that it is possible to reduce power consumed before shifting to the second mode is performed when the remaining amount of the power supply is low.

(4) The power supply unit according to (2), in which the aerosol generation source includes a flavor source (a flavor source 33) configured to add a flavor component to an aerosol generated from an aerosol source (an aerosol source 22), in which the load is configured to heat the flavor source, in which the processing device is configured to control discharging from the power supply to the load such that a temperature of the flavor source converges to a target temperature of any one of a plurality of values, and in which the variable is the target temperature.

According to (4), the timing of shifting to the second mode is determined based on the target temperature of the flavor source. For example, in a state where the target temperature is high, power required for maintaining the temperature of the flavor source at the target temperature may be increased as compared with a state where the target temperature is low. Therefore, for example, in a state where the target temperature is high, by advancing the timing of shifting to the second mode as compared with a state where the target temperature is low, it is possible to suppress consumption of a large amount of power in order to maintain the temperature of the flavor source at the target temperature.

(5) The power supply unit according to (2), in which the aerosol generation source includes a flavor source (a flavor source 33) configured to add a flavor component to an aerosol generated from an aerosol source (an aerosol source 22), in which the load is configured to heat the flavor source, in which the processing device is configured to control discharging from the power supply to the load such that a temperature of the flavor source converges to a target temperature of any one of a plurality of values, and in which the variable is a difference between the target temperature and an ambient temperature of the power supply unit.

According to (5), the timing of shifting to the second mode is changed based on the difference between the target temperature and the ambient temperature. For example, in a state where the difference between the target temperature and the ambient temperature is large, the power required for maintaining the temperature of the flavor source at the target temperature may be increased as compared with a state where the difference is small. Therefore, for example, in a state where the difference is large, by advancing the timing of shifting to the second mode as compared with a state where the difference is small, it is possible to suppress consumption of a large amount of power in order to maintain the temperature of the flavor source at the target temperature.

(6) The power supply unit according to (2), in which the variable includes a first variable (a variable Pb) and a second variable (a variable Pt) having a physical quantity different from that of the first variable, in which the processing device sets a first value based on the first variable, in which the processing device sets a second value based on the second variable, and in which the processing device shifts the power supply unit to the second mode when the period exceeds a difference between the predetermined time and a sum of the first value and the second value.

According to (6), the timing of shifting to the second mode can be individually adjusted with a plurality of variables. Therefore, even when the plurality of variables are used, it is possible to appropriately manage the timing of shifting to the second mode while avoiding a conflict.

(7) The power supply unit according to (6), in which a sum of a maximum value (a value AM1) of the first value and a maximum value (a value AM2) of the second value is less than the predetermined time.

According to (7), the difference between the predetermined time and the sum of the first value and the second value is a value larger than "0" regardless of a value of a variable. Therefore, it is possible to prevent a mode from being shifted to the second mode at an extremely early time, and it is possible to improve usability.

(8) The power supply unit according to (1), in which the processing device causes the power supply unit to operate in a third mode (a power-saving mode (a first power-saving mode, a second power-saving mode)) in which a maximum power consumption amount is smaller than the first power consumption amount and larger than that in the second mode, and in which the processing device performs shifting to the third mode at a timing before the period exceeds the predetermined time (the predetermined time TM1) in the first mode.

According to (8), since the third mode is provided before shifting to the second mode is performed, power consumption can be reduced before shifting to the second mode is performed.

(9) The power supply unit according to (8), in which the aerosol generation source includes a flavor source (a flavor source 33) configured to add a flavor component to an aerosol generated from an aerosol source (an aerosol source 22), in which the load is configured to heat the flavor source, in which the processing device is configured to control discharging from the power supply to the load such that a temperature of the flavor source converges to a target temperature, and in which in the third mode (the first power-saving mode), the target temperature is made lower than that in the first mode.

According to (9), the target temperature is lower in the third mode than in the first mode. Therefore, it is possible to implement an increase in the amount of the flavor component contained in the aerosol by heating the flavor source while reducing power consumption.

(10) The power supply unit according to (9), in which the processing device increases the target temperature when the signal is acquired in the third mode (the first power-saving mode).

According to (10), even when the target temperature of the flavor source is lowered in the third mode, the target temperature is raised when the aerosol is generated. Therefore, even when the target temperature is lowered for power saving, the reduction in the amount of the flavor component contained in the aerosol can be prevented.

(11) The power supply unit according to (10), in which the aerosol generation source includes the aerosol source, in which the load is configured to heat the aerosol source, and in which the processing device increases, when the signal is acquired in the third mode (the first power-saving mode), power discharged from the power supply to the load as compared with power discharged from the power supply to the load when the signal is acquired in the first mode without shifting to the third mode.

According to (11), even when the target temperature of the flavor source is lowered in the third mode, power supplied to the load is raised when generating the aerosol. Therefore, even when the target temperature is lowered for power saving, the reduction in the amount of the flavor component contained in the aerosol can be prevented.

(12) The power supply unit according to (9), in which the aerosol generation source includes the aerosol source, in which the load is configured to heat the aerosol source, and in which the processing device increases, when the signal is acquired in the third mode (the first power-saving mode), power discharged from the power supply to the load to heat the aerosol source as compared with power discharged from the power supply to the load to heat the aerosol when the signal is acquired in the first mode without shifting to the third mode.

According to (12), even when the target temperature of the flavor source is lowered in the third mode, power supplied to the load is raised when generating the aerosol. Therefore, even when the target temperature is lowered for power saving, the reduction in the amount of the flavor component contained in the aerosol can be prevented.

(13) The power supply unit according to (8), in which the aerosol generation source includes a flavor source (a flavor source 33) configured to add a flavor component to an aerosol generated from an aerosol source (an aerosol source 22), in which the load is configured to heat the flavor source, and in which in the third mode (the second power-saving mode), the processing device stops heating of the flavor source by the load.

According to (13), since discharging to the load is stopped in the third mode, power consumption can be fairly reduced.

(14) The power supply unit according to (13), in which the aerosol generation source includes the aerosol source, in which the load is configured to heat the aerosol source, and in which when the signal is acquired in the third mode (the second power-saving mode), the processing device allows discharging from the power supply to the load such that the flavor source and the aerosol source are heated in parallel.

According to (14), even when heating of the flavor source is stopped in the third mode, both the flavor source and the aerosol source are heated when generating the aerosol. Therefore, even when heating of the flavor source is stopped for power saving, a reduction in the amount of the flavor component contained in the aerosol can be prevented.

(15) The power supply unit according to (14), in which when the signal is acquired in the third mode (the second power-saving mode), the processing device alternately performs discharging from the power supply to the load for heating the aerosol source and discharging from the power supply to the load for heating the flavor source.

According to (15), it is possible to avoid heating the flavor source and the aerosol source at the same time. Therefore, deterioration of the power supply due to discharging of a large current from the power supply can be prevented.

(16) The power supply unit according to (1), in which in a state before shifting to the second mode is performed, the processing device reduces a maximum power consumption amount according to the period.

According to (16), the maximum power consumption amount is reduced according to the period during which the signal is not acquired. Therefore, it is possible to reduce power consumption before shifting to the second mode is performed.

(17) A power supply unit (a power supply unit 10) for an aerosol inhaler (an aerosol inhaler 1) including a power supply (a power supply 12) configured to be dischargeable to a load configured to heat an aerosol generation source (an aerosol source 22, a flavor source 33), a first sensor (an intake sensor 15) configured to output a signal indicating an aerosol generation request, and a processing device (an MCU 50) configured to acquire the signal from the first sensor, in which the processing device causes the power supply unit to operate in a first mode (an activation mode) in which a maximum power consumption amount is a first power consumption amount and a second mode (a sleep mode) in which a maximum power consumption amount is smaller than the first power consumption amount, causes the power supply unit to operate in the second mode when a period (a non-suction time) during which the signal is not acquired exceeds a predetermined time (a sleep shifting time) in the first mode, and variably controls the predetermined time.

According to (17), the timing of shifting to the second mode is not fixed. Therefore, it is possible to shift to the second mode at an appropriate timing according to a state of the power supply unit. As a result, power consumption can be reduced and more power can be discharged to the load when the aerosol generation request is made. Therefore, a sufficient amount of aerosol can be provided to the user, and a commercial value of the aerosol inhaler can be increased.

(18) A power supply unit (a power supply unit 10) for an aerosol inhaler (an aerosol inhaler 1) including a power supply (a power supply 12) configured to be dischargeable to a load configured to heat an aerosol generation source (an aerosol source 22, a flavor source 33), a first sensor (an intake sensor 15) configured to output a signal indicating an aerosol generation request, and a processing device (an MCU 50) configured to acquire the signal from the first sensor, in which the processing device reduces a maximum power consumption amount according to a length of the period during which the signal is not acquired.

According to (18), the maximum power consumption amount is reduced according to the period during which the signal is not acquired. Therefore, power consumption can be reduced. As a result, more power can be discharged to the load when the aerosol generation request is made. Therefore, a sufficient amount of aerosol can be provided to the user, and a commercial value of the aerosol inhaler can be increased.

(19) A power supply unit (a power supply unit 10) for an aerosol inhaler (an aerosol inhaler 1) including a power supply (a power supply 12) configured to be dischargeable to a load configured to atomize an aerosol source (an aerosol source 22), a first sensor (an intake sensor 15) configured to output a signal indicating an aerosol generation request, and a processing device (an MCU 50) configured to acquire the signal from the first sensor, in which the processing device causes the power supply unit to operate in a first mode (an activation mode) in which a maximum power consumption amount is a first power consumption amount and a second mode (a sleep mode) in which a maximum power consumption amount is smaller than the first power consumption amount, causes the power supply unit to operate in the second mode when a period (a non-suction time) during which the signal is not acquired exceeds a predetermined time (a sleep shifting time) in the first mode, and variably controls the predetermined time.

According to (19), a timing of shifting to the second mode is not fixed. Therefore, it is possible to shift to the second mode at an appropriate timing according to a state of the power supply unit. As a result, power consumption can be reduced and more power can be discharged to the load when the aerosol generation request is made. Therefore, a sufficient amount of aerosol can be provided to the user, and a commercial value of the aerosol inhaler can be increased.

(20) A power supply unit (a power supply unit 10) for an aerosol inhaler (an aerosol inhaler 1) including a power supply (a power supply 12) configured to be dischargeable to a load configured to atomize an aerosol source (an aerosol source 22), a first sensor (an intake sensor 15) configured to output a signal indicating an aerosol generation request, and a processing device (an MCU 50) configured to acquire the signal from the first sensor, in which the processing device reduces a maximum power consumption amount according to a length of the period during which the signal is not acquired.

According to (20), the maximum power consumption amount is reduced according to the period during which the signal is not acquired. Therefore, power consumption can be reduced. As a result, more power can be discharged to the load when the aerosol generation request is made. Therefore, a sufficient amount of aerosol can be provided to the user, and a commercial value of the aerosol inhaler can be increased.

(21) An aerosol inhaler including:

the power supply unit according to any one of (1) to (18);

the aerosol generation source; and the load.

What is claimed is:

1. A power supply unit for an aerosol inhaler comprising:

a power supply dischargeable to a load configured to heat an aerosol generation source;

a first sensor configured to output a signal indicating an aerosol generation request; and a processing device configured to acquire the signal from the first sensor, wherein the aerosol generation source includes a flavor source configured to add a flavor component to an aerosol generated from an aerosol source, wherein the load is configured to heat the flavor source, wherein the processing device is configured to control discharging from the power supply to the load such that a temperature of the flavor source converges to a target temperature of any one of a plurality of values, wherein the processing device is configured to cause the power supply unit to operate in a first mode in which a maximum power consumption amount is a first power consumption amount and a second mode in which a maximum power consumption amount is smaller than the first power consumption amount, and causes the power supply unit to operate in the second mode when a period during which the signal is not acquired exceeds a predetermined time in the first mode, and wherein the processing device is configured to cause the power supply unit to operate in the second mode at a timing before the period exceeds the predetermined time in the first mode, and determines the timing based on the target temperature.

2. A power supply unit for an aerosol inhaler comprising:

a power supply configured to be dischargeable to a load configured to heat an aerosol generation source;

a first sensor configured to output a signal indicating an aerosol generation request; and a processing device configured to acquire the signal from the first sensor, wherein the processing device is configured to cause the power supply unit to operate in a first mode in which a maximum power consumption amount is a first power consumption amount and a second mode in which a maximum power consumption amount is smaller than the first power consumption amount, and causes the power supply unit to operate in the second mode when a period during which the signal is not acquired exceeds a predetermined time in the first mode, wherein the processing device is configured to cause the power supply unit to operate in the second mode at a timing before the period exceeds the predetermined time in the first mode and determines the timing based on a variable related to a state of the power supply unit, wherein the variable includes a first variable and a second variable different from that of the first variable in physical quantity, wherein the processing device sets a first value based on the first variable, wherein the processing device sets a second value based on the second variable, and wherein the processing device shifts the power supply unit to the second mode when the period exceeds a difference between the predetermined time and a sum of the first value and the second value.

3. The power supply unit according to claim 2, wherein a sum of a maximum value of the first value and a maximum value of the second value is less than the predetermined time.

4. A power supply unit for an aerosol inhaler comprising:

a power supply configured to be dischargeable to a load configured to heat an aerosol generation source;

a first sensor configured to output a signal indicating an aerosol generation request; and a processing device configured to acquire the signal from the first sensor, wherein the aerosol generation source includes a flavor source configured to add a flavor component to an aerosol generated from an aerosol source, wherein the load is configured to heat the flavor source, wherein the processing device is configured to control discharging from the power supply to the load such that a temperature of the flavor source converges to a target temperature, wherein the processing device is configured to cause the power supply unit to operate in a first mode in which a maximum power consumption amount is a first power consumption amount and a second mode in which a maximum power consumption amount is smaller than the first power consumption amount, and causes the power supply unit to operate in the second mode when a period during which the signal is not acquired exceeds a predetermined time in the first mode, wherein the processing device is configured to cause the power supply unit to operate in a third mode in which a maximum power consumption amount is smaller than the first power consumption amount and larger than that in the second mode, and shifts the power supply unit to the third mode at a timing before the period exceeds the predetermined time in the first mode, and wherein in the third mode, the processing device decreases the target temperature lower than that in the first mode.

5. The power supply unit according to claim 4, wherein the processing device increases the target temperature when acquiring the signal in the third mode.

6. The power supply unit according to claim 5, wherein the aerosol generation source includes the aerosol source, wherein the load is configured to heat the aerosol source, and wherein the processing device increases, when the signal is acquired in the third mode, power discharged from the power supply to the load as compared with power discharged from the power supply to the load when the signal is acquired in the first mode without shifting to the third mode.

7. The power supply unit according to claim 4, wherein the aerosol generation source includes the aerosol source, wherein the load is configured to heat the aerosol source, and wherein the processing device increases, when the signal is acquired in the third mode, power discharged from the power supply to the load to heat the aerosol source as compared with power discharged from the power supply to the load to heat the aerosol when the signal is acquired in the first mode without shifting to the third mode.

8. An aerosol inhaler comprising:

the power supply unit according to claim 1;

the aerosol generation source; and the load.

* * * * *